US012760522B2

(12) United States Patent
Pomerantz

(10) Patent No.: US 12,760,522 B2
(45) Date of Patent: Oct. 13, 2026

(54) RAINWATER DIVERTER APPARATUS

(71) Applicant: Larry Pomerantz, Hamilton (CA)

(72) Inventor: Larry Pomerantz, Hamilton (CA)

( * ) Notice: Subject to any disclaimer, the term of this patent is extended or adjusted under 35 U.S.C. 154(b) by 79 days.

(21) Appl. No.: 18/608,614

(22) Filed: Mar. 18, 2024

(65) Prior Publication Data

US 2025/0290322 A1 Sep. 18, 2025

(51) Int. Cl.
*E04D 13/08* (2006.01)

(52) U.S. Cl.
CPC ..... *E04D 13/08* (2013.01); *E04D 2013/0813* (2013.01); *E04D 2013/082* (2013.01)

(58) Field of Classification Search
CPC ..... E04D 13/08; E04D 2013/0813; E04D 2013/082; E04D 2013/0853
See application file for complete search history.

(56) References Cited

U.S. PATENT DOCUMENTS 5,533,303 A * 7/1996 Harvey ..... E03B 3/02 52/16
8,033,058 B2 * 10/2011 Block ..... E04D 13/08 52/12
8,517,047 B2 * 8/2013 Teoh ..... E04D 13/08 210/170.03
9,988,817 B2 * 6/2018 Johnson ..... E04D 13/08
10,017,920 B1 * 7/2018 Huxford ..... E03F 1/002
10,472,830 B1 * 11/2019 Middleton ..... E03B 3/02
2016/0033048 A1 2/2016 Noah
2023/0302385 A1 * 9/2023 Sherwood ..... E04D 13/08

* cited by examiner

*Primary Examiner* — Kevin F Murphy
(74) *Attorney, Agent, or Firm* — Aird & Berlis LLP

(57) ABSTRACT

A rainwater diverter apparatus for use on a downspout is provided. The rainwater diverter apparatus comprises a housing body that includes: an inlet, a primary outlet that is formed in a first bottom section of the housing body and a water-receiving reservoir that is formed within a second bottom section of the housing body that is separate from the first bottom section. The rainwater diverter apparatus also includes a water deflector, which in some embodiments is removably mountable within the housing body. The water deflector can be positioned in either a first deflection position for deflecting rainwater towards the primary outlet and a second deflection position for deflecting rainwater towards the water-receiving reservoir. An underside of the water deflector includes a deflecting lip that is shaped such that the movement of rainwater up the underside of the water deflector is inhibited.

21 Claims, 21 Drawing Sheets

RAINWATER DIVERTER APPARATUS

FIELD OF THE DISCLOSURE

The present disclosure relates generally to means for collecting rainwater. In particular, the disclosure relates to a rainwater diverter apparatus.

BACKGROUND OF THE DISCLOSURE

Gutters and downspouts are commonly installed on residential and commercial buildings along the lower edge of the roof. Their purpose is to collect water that drains off the roof, especially during rainfall. There are various styles of gutters available, such as K-gutters, half round gutters, and commercial box gutters. However, all of them have an open top that allows water to flow into a trough or channel. This water is then directed by gravity to a downspout, which carries it away from the structure. The gutters are typically supported by multiple hangers spaced along their length and attached to fascia boards using nails or screws. The downspout is connected to the gutter's outlet, creating a conduit for draining the collected rainwater along the ground and away from the building. The practice of collecting rainwater has been in use for many years. Usually, the collected rainwater is used for non-potable purposes like irrigation, laundry, or personal hygiene. It is commonly collected from the downspout and stored in containers, such as barrels, for future use. Utilizing collected rainwater offers cost advantages as it is obtained without significant expenses. Moreover, it promotes water conservation and allows for better management of less cost-effective water supplies. Rainwater harvesting is a widespread practice globally and serves as a vital resource in many developing countries where water scarcity is a major issue. The ability to capture water that would otherwise go to waste from rooftops is gaining popularity worldwide.

Collection systems for harvesting rainwater have been developed for many years and are generally defined as a device for intercepting the downward flow of rainwater within a downspout and diverting the rainwater to a location remote from the downspout. One such rainwater collector can be found in U.S. Pat. No. 4,182,376, granted to Bernt Nilsson on Jan. 8, 1980, wherein a dispensing device is formed to be inserted into an intermediate portion of a downspout and defines a collection pocket by a circumferential wall portion that drains into a discharge spout. The Nilsson device does not include any filtration of the descending rainwater but does provide an overflow from the collection pocket over the edge thereof into the lower downspout portion. In U.S. Pat. No. 4,386,484, granted on Jun. 7, 1983, to Joost van Berne, et al, the collection device incorporates a reception cavity into which rainwater is deflected until the cavity is filled, whereupon an opening at the upper part of the cavity allows overflow back into the lower downspout portion. The reception cavity is formed with a discharge spout to drain rainwater from the cavity to a location remote from the device.

Another deflector apparatus is found in the collection device disclosed in U.S. Pat. No. 4,428,394, issued on Jan. 31, 1984, to Jack Wright, et al, in which rainwater is deflected from the downspout into a discharge spout for diversion of the rainwater into a remote collection vessel. The Wright deflection apparatus is operably connected to a float associated with the collection vessel so that when the collection vessel is filled with diverted rainwater, the deflector apparatus is shifted to allow the rainwater to continue uninterrupted down the downspout. The collection apparatus in U.S. Pat. No. 4,726,151, issued to Benedetto Vitale on Feb. 23, 1988, is connected directly to the gutter discharge, and collects rainwater in a reservoir having an outlet projecting upwardly therein to define a weir over which the collected rainwater will flow into the attached downspout. The reservoir is formed with a discharge spout to allow the diversion of the collected rainwater to a remote location.

It is therefore an object of the disclosure to provide a novel rainwater diverter apparatus for harvesting rainwater from a downspout that can provide complete or near-complete diversion of all the rainwater flowing through the apparatus, while also providing an apparatus that will be easy to clean and where the functioning of the diverter apparatus will not be substantially affected by regular quantities of ice or snow within the apparatus.

SUMMARY OF THE DISCLOSURE

According to an aspect, there is provided a rainwater diverter apparatus for use on a downspout, the rainwater diverter apparatus comprising: a housing body that includes: an inlet that is shaped to interface with an upstream portion of downspout for fluidly connecting an interior of the housing body and the downspout; a primary outlet that is formed in a first bottom section of the housing body and that is shaped to interface with a downstream portion of the downspout; a water-receiving reservoir that is formed within a second bottom section of the housing body that is separate from the first bottom section; a plurality of secondary outlets that are positioned on the second bottom section of the housing body; and a water deflector that is mountable within the housing body in both a first deflection position for deflecting rainwater towards the primary outlet and a second deflection position for deflecting rainwater towards the water-receiving reservoir, an underside of the water deflector including a deflecting lip that has a first side, a second side, and a terminal edge formed between the first and second sides; wherein each of the first side and the second side of the deflecting lip extend upwardly away from the terminal edge of the deflecting lip such that the movement of rainwater up the underside of the water deflector once the rainwater has been deflected along the water deflector is inhibited; and wherein the water deflector is shaped such that when the water deflector is in the first deflecting position, the entirety of the deflecting lip is disposed over the first bottom section for deflecting the rainwater into only the first bottom section, and when the water deflector is in the second deflecting position, the entirety of the deflecting lip is disposed over the second bottom section for deflecting the rainwater into only the second bottom section.

According to another aspect, there is provided a rainwater diverter apparatus for use on a downspout, the rainwater diverter apparatus comprising: a housing body that includes: an inlet that is shaped to interface with an upstream portion of downspout for fluidly connecting an interior of the housing body and the downspout; a primary outlet that is formed in a first bottom section of the housing body and that is shaped to interface with a downstream portion of the downspout; a water-receiving reservoir that is formed within a second bottom section of the housing body that is separate from the first bottom section; and a plurality of secondary outlets that are fluidly connectable to at least one external collection reservoir and that are positioned on at least one sidewall of the second bottom section of the housing body; and a water deflector that is manipulatable between a first deflection position for deflecting rainwater towards the primary outlet, and a second deflection position for deflecting rainwater towards the water-receiving reservoir; wherein a cross-sectional area of the inlet is substantially equivalent to a cross-sectional area of the primary outlet such that the bottlenecking of rainwater flowing through the primary outlet is substantially inhibited, and wherein the cross-sectional area of the inlet is substantially equivalent to a combined cross-sectional area of the plurality of secondary outlets such that the bottlenecking of rainwater flowing through the plurality of secondary outlets is substantially inhibited.

According to another aspect, there is provided a rainwater diverter apparatus for use on a downspout, the rainwater diverter apparatus comprising: a housing body that includes: an inlet that is formed on a top end of the housing body and that is shaped to interface with an upstream portion of downspout for fluidly connecting an interior of the housing body and the downspout; a primary outlet that is formed in a first bottom section of the housing body and that is shaped to interface with a downstream portion of the downspout; a water-receiving reservoir that is formed within a second bottom section of the housing body that is separate from the first bottom section; a plurality of secondary outlets that are positioned on the second bottom section of the housing body and that are fluidly connectable to at least one external collection reservoir; and a water deflector that includes an upstream end, a downstream end, and a deflecting surface extending between the upstream and downstream ends, the water deflector being removably mountable within the interior of the housing body, at least partly below the inlet, in a first deflection position for deflecting rainwater towards the primary outlet or a second deflection position for deflecting rainwater towards the water-receiving reservoir.

According to yet another aspect, there is provided a rainwater diverter apparatus for use on a downspout, the rainwater diverter apparatus comprising: a housing body that includes: an inlet that is shaped to interface with an upstream portion of downspout for fluidly connecting an interior of the housing body and the downspout; a primary outlet that is formed in a first bottom section of the housing body and that is shaped to interface with a downstream portion of the downspout; a water-receiving reservoir that is formed within a second bottom section of the housing body that is separate from the first bottom section; a plurality of secondary outlets that are positioned on the second bottom section of the housing body; and a water deflector that is mountable within the housing body in both a first deflection position for deflecting rainwater towards the primary outlet and a second deflection position for deflecting rainwater towards the water-receiving reservoir, a downstream edge of the water deflector forming a deflecting lip that includes an underside, a topside and a terminal edge between the underside and top side; wherein each of the topside and the underside of the deflecting lip extend upwardly away from the terminal edge of the deflecting lip for inhibiting the movement of rainwater up an underside of the water deflector once the rainwater has been deflected along the water deflector such that the rainwater is deflected towards only one of the primary outlet and the water-receiving reservoir, wherein the water deflector is structured such that when the water deflector is in the first deflection position the entirety of the deflecting lip is disposed over either the first bottom section for deflecting the rainwater only into the first bottom section, and when the water deflector is in the second deflection position, the entirety of the deflecting lip is disposed over the second bottom section for deflecting the rainwater only into the second bottom section.

BRIEF DESCRIPTION OF THE DRAWINGS

Embodiments will now be described, by way of example only, with reference to the attached Figures, wherein.

DETAILED DESCRIPTION OF THE EMBODIMENTS

Figure 1:
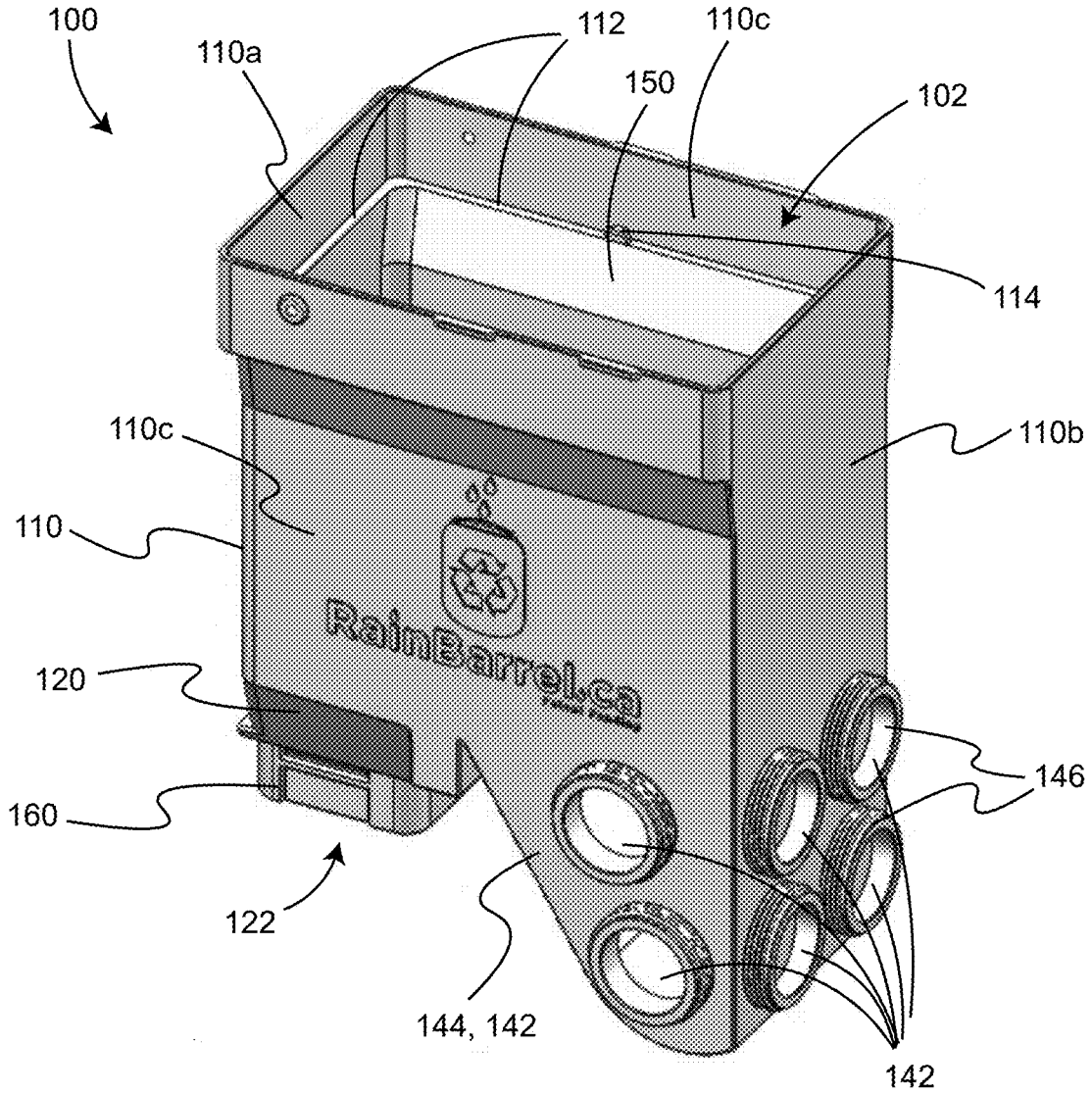
FIG. 1 shows a perspective view of the rainwater diverter apparatus according to an embodiment of the present disclosure.

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures, and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

As used herein, the terms "comprises" and "comprising" are to be construed as being inclusive and open ended, and not exclusive. Specifically, when used in the specification and claims, the terms "comprises" and "comprising", and variations thereof mean the specified features, steps or components are included. These terms are not to be interpreted to exclude the presence of other features, steps, or components.

As used herein, the terms "about" and "approximately" are meant to cover variations that may exist in the upper and lower limits of the ranges of values, such as variations in properties, parameters, and dimensions.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns such that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" or "an" will be understood to denote "at least one" in all instances unless explicitly stated otherwise or unless it would be understood to be obvious that it must mean "one".

Modifications, additions, or omissions may be made to the systems, apparatuses, and methods described herein without departing from the scope of the disclosure.

As used in this document, "attached" in describing the relationship between two connected parts includes the case in which the two connected parts are "directly attached" with the two connected parts being in contact with each other, and the case in which the connected parts are "indirectly attached" and not in contact with each other but connected by one or more intervening other part(s) between.

As used in this document, terms describing relative positions of elements such as 'top', 'upper', 'bottom', 'lower', or other analogous terms will be understood to refer to the placement of the described element during use of the apparatus of which it is a part unless the context would make it clear that it is otherwise. It will be understood that the aforementioned placement of an element, for example, can still be considered its placement even when the object that it is a part of is lying in some position other than the position in which it will be used. As an example, if reference is made to a device having an upper member, it will be understood that the upper member is being described as having an upper position when the device that it is a part of is in use or is in position for use, unless the context would make it clear that it is otherwise. Further to this example, it will be understood that the aforementioned upper member of the object can still be considered its upper member even when the object is lying on its side, for storage, or for transport, or for some other reason.

Referring to FIGS. 1, 2A, 2B, 3B and 3C there is provided a rainwater diverter apparatus 100 for use on a downspout. The rainwater diverter apparatus 100 comprises a housing body 110 that includes an inlet 102 that is shaped to interface with an upstream portion of downspout for fluidly connecting an interior of the housing body 110 and the downspout, as well as a primary outlet 122 that is formed in a first bottom housing section 120 of the housing body 110 and that is shaped to interface with a downstream portion of the downspout. The housing body 110 also includes a water-receiving reservoir 144 that is formed within a second bottom housing section 140 of the housing body 110, where the second bottom housing section 140 is separate from the first bottom housing section 120. The rainwater diverter apparatus 100 also includes a plurality of secondary outlets 142 that are positioned on the second bottom housing section 140 of the housing body 110, and a water deflector 150 that is positionable within the housing body 110 in both a first deflection position for deflecting rainwater towards the primary outlet 122 (see FIG. 2B) and a second deflection position for deflecting rainwater towards the water-receiving reservoir 144 (see FIG. 2A). An underside of the water deflector 150 includes a deflecting lip 310 that has a first side 310*a*, a second side 310*b*, and a terminal edge 310*c* formed between the first and second sides 310*a*, 310*b*.

As shown in FIGS. 2A, 2B, 3A and 3B, the rainwater diverter apparatus 100 is structured such that each of the first side 310*a* and the second side 310*b* of the deflecting lip 310 extend upwardly away from the terminal edge 310*c* of the deflecting lip 310 such that the movement of rainwater up the underside of the water deflector 150 (once the rainwater has been deflected along the water deflector 150) is inhibited.

By providing a rainwater diverter apparatus 100 with a water deflector 150 and deflecting lip 310 which are structured such that the first and second sides 310*a*, 310*b* of the deflecting lip 310 extend upwards from the terminal edge 310*c*, the deflecting lip 310 will substantially inhibit any movement of rainwater along the underside of the water deflector 150. Rainwater (in the form of water droplets) which begins to move along the underside of the water deflector 150 will be directed along the first side 310*a* of the deflecting lip 310. When the water droplets of the rainwater reach the terminal edge 310*c* of the deflecting lip 310, the droplets will be unable to continue moving along the deflecting lip 310 to the second side 310*b*, as the contact angle that each water droplet must traverse between the first and second sides 310*a*, 310*b* will be too great. This extreme contact angle between the first and second sides 310*a*, 310*b* occurs because the first and second sides 310*a,* 310*b* are structured to extend upwards, away from the terminal edge 310*c*.

In some embodiments, the water deflector 150 of the rainwater diverter apparatus 100 is also shaped such that when the water deflector 150 is in the first deflection position, the entirety of the deflecting lip 310 of the water deflector 150 is disposed over the first bottom housing section 120 for deflecting the rainwater into only the first bottom housing section 120, and when the water deflector 150 is in the second deflection position, the entirety of the deflecting lip 310 of the water deflector 150 is disposed over the second bottom housing section 140 for deflecting the rainwater into only the second bottom housing section 140.

By forming the water deflector 150 such that the deflecting lip 310 will be disposed over either the first or second bottom housing sections 120, 140, water droplets which are deflected down by the deflecting lip 310 will still only fall into the desired one of the primary outlet 122 and the water-receiving reservoir 144 within the housing body 110.

Figure 2A:
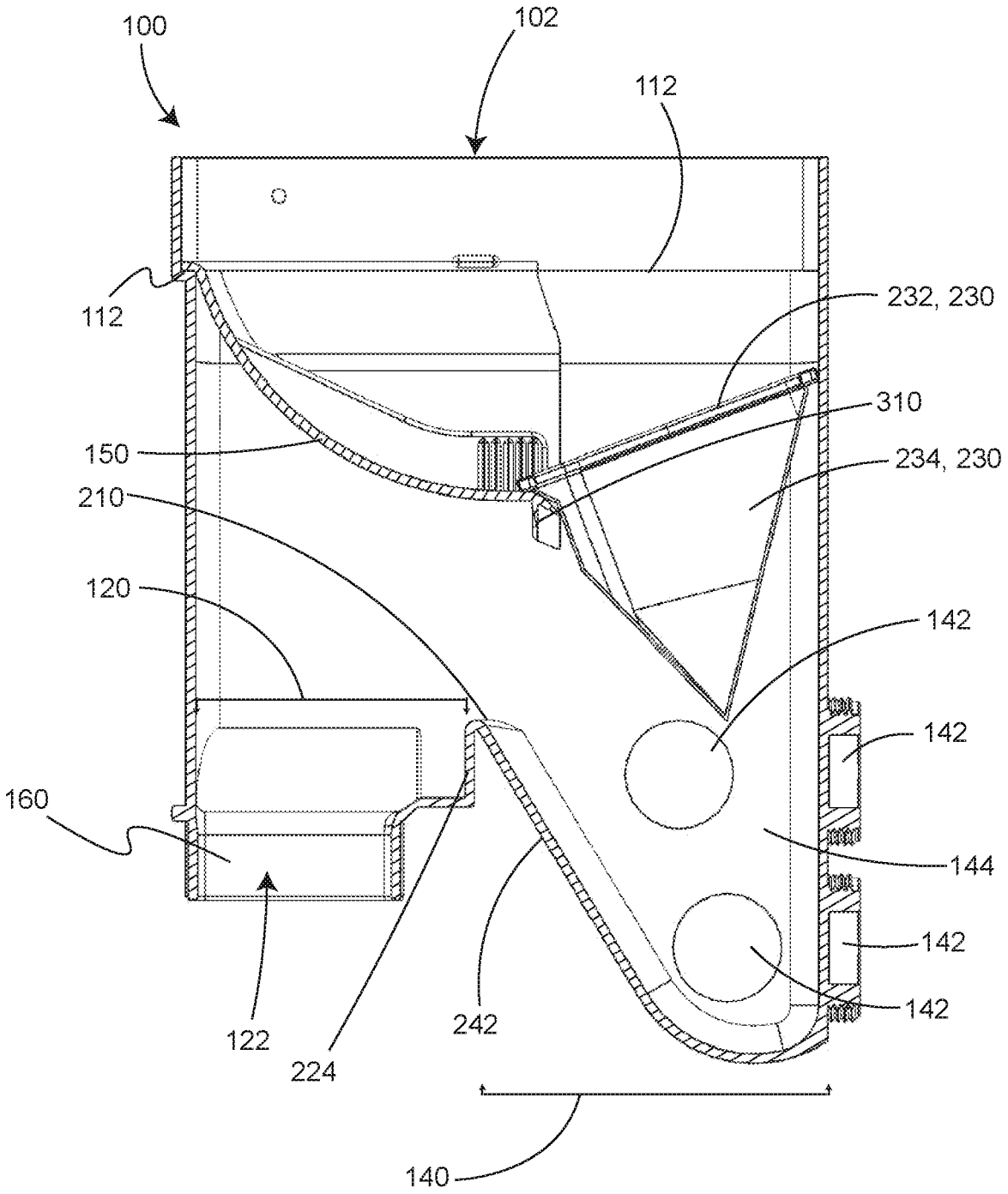
FIG. 2A shows a side, section view of the embodiment of the rainwater diverter apparatus of FIG. 1, where the water deflector is in the second deflection position.
Figure 2B:
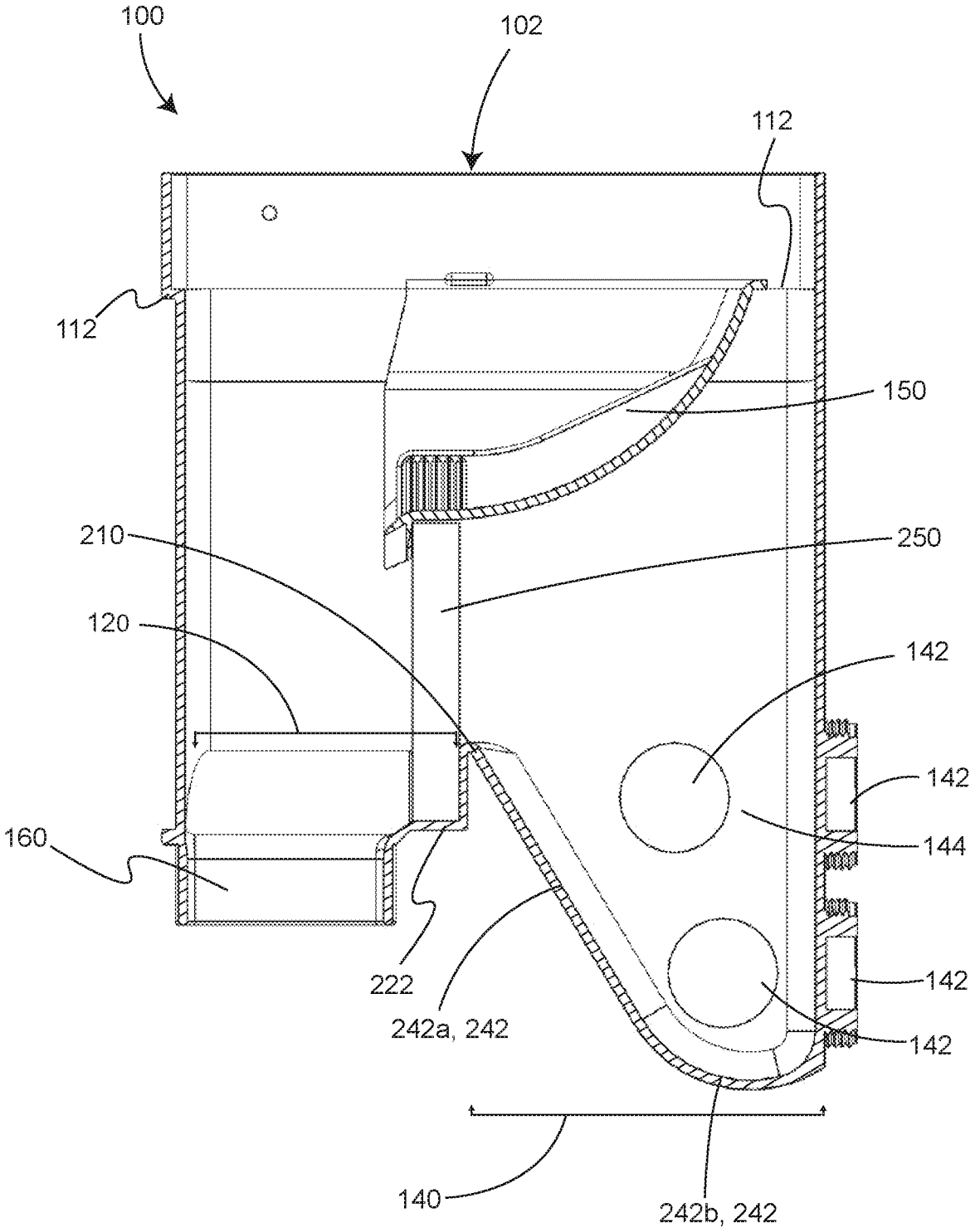
FIG. 2B shows a side, section view of the embodiment of the rainwater diverter apparatus of FIG. 1, where the water deflector is in the first deflection position.
Figure 3A:
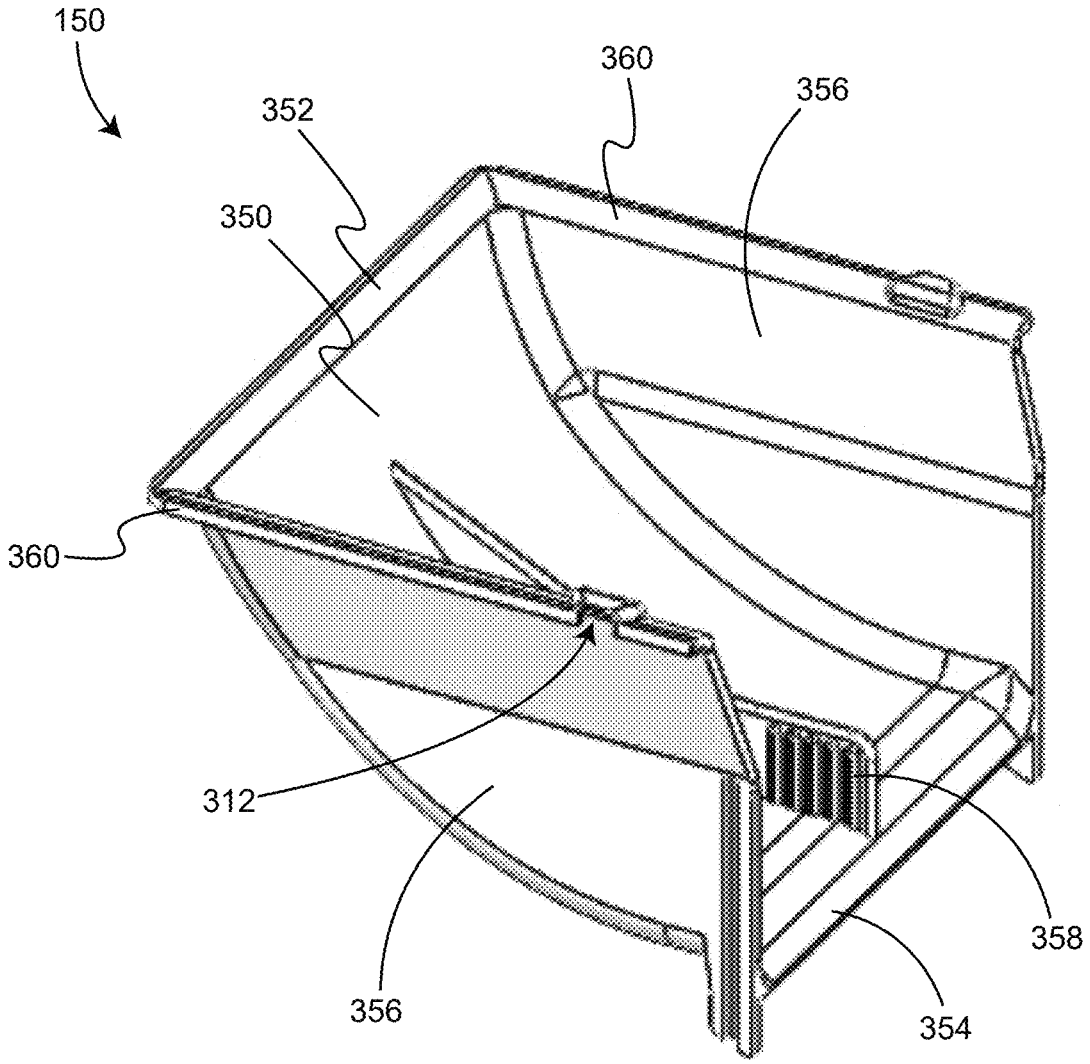
FIG. 3A shows a perspective view of the water deflector of the embodiment of the rainwater diverter apparatus of FIG. 1.
Figure 3B:
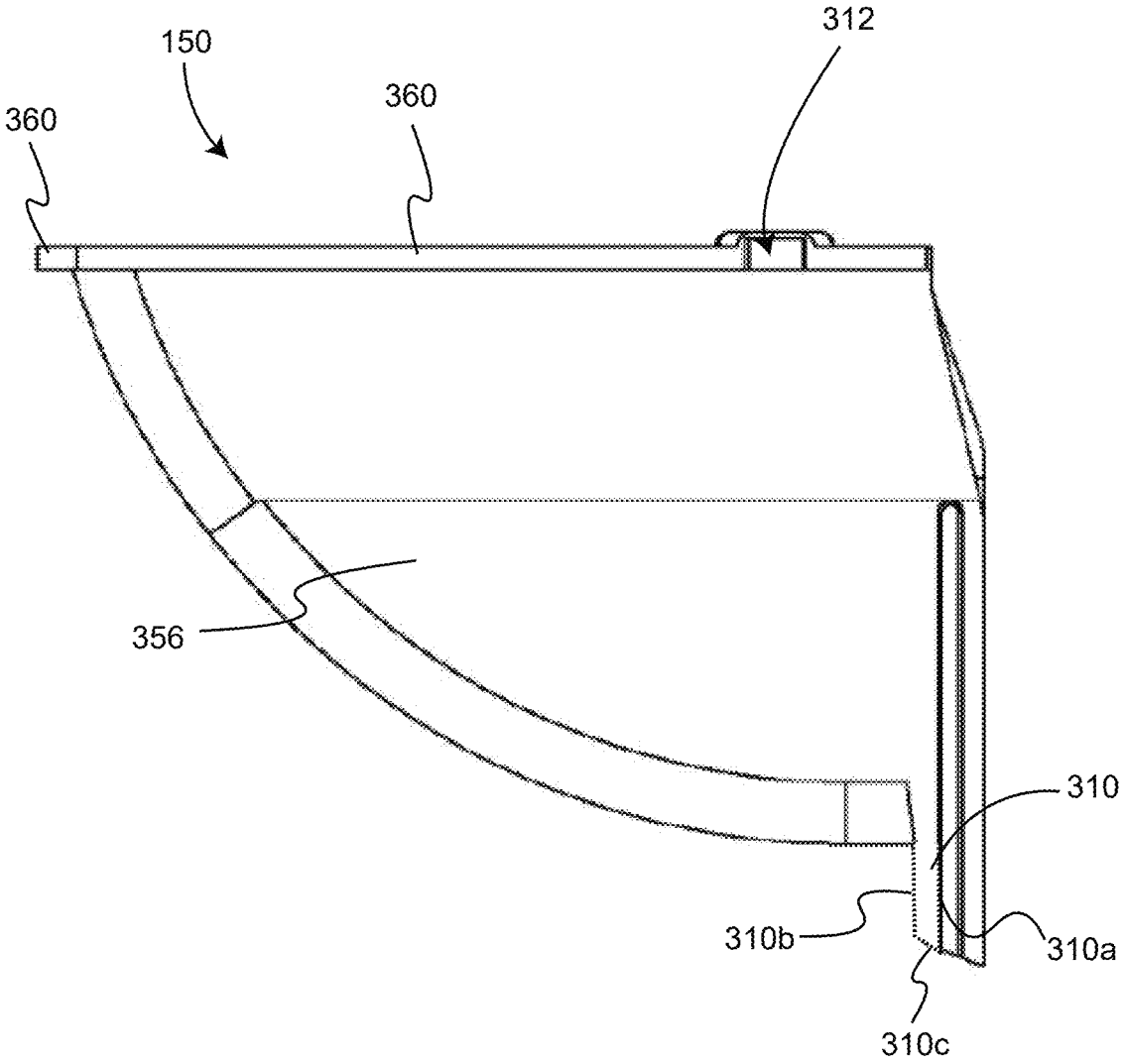
FIG. 3B shows a side view of the embodiment of the water deflector of FIG. 3A.

In an additional embodiment such as shown in FIGS. 2A, 2B and 3B, the terminal edge 310*c* of the deflecting lip 310 is angled upwards towards the upstream end 352 of the water deflector 150 for further inhibiting the movement of rainwater up the underside of the water deflector 150 once the rainwater has been deflected along the water deflector 150. By providing an upwards angle on the terminal edge 310*c* of the deflecting lip 310, the change in contact angle between the first and second sides 310*a,* 310*b* of the deflecting lip 310 is increased, and thus the likelihood that a water droplet could travel from the first to the second side 310*b* of the deflecting lip 310 is further reduced. Again, due to the structure and positioning of the deflecting lip 310, water droplets which are deflected down by the deflecting lip 310 will still only fall into the desired one of the primary outlet 122 and the water-receiving reservoir 144 within the housing body 110.

The components of the rainwater diverter apparatus 100 as disclosed herein may be composed of various plastics, rubbers, metals, foams, rigid foams, or other appropriate materials. Preferably, the material of the components of the rainwater diverter apparatus 100 are non-corrosive metal, molded plastic, or rigid foam.

Referring to FIGS. 1, 2A and 2B, the housing body 110 of the rainwater diverter apparatus 100 is structured as a hollow body with an internal cavity that receives the rainwater and defines the interior of the housing body 110. The interior cavity of the housing body 110 can be said to define three distinct but fluidly-connected sections of the housing body 110. Described sequentially from top to bottom, these fluidly connected sections include a top, rainwater receiving section, a first rainwater merging, collecting and diverting section, and a second, front rainwater draining section where the first bottom housing section 120 is defined at the bottom of the first rainwater merging, collecting and diverting section and the second bottom housing section 140 is defined at the bottom of the second rainwater merging, collecting and diverting section. The second rainwater merging, collecting, and diverting section also defines the water-receiving reservoir 144 of the housing body 110.

In the specific embodiment provided in FIGS. 1, 2A and 2B, the housing body 110 has a generally rectangular shape with a bottom wall, a front wall 110*b,* a rear wall 110*a,* and opposing main sidewalls 110*c* that extend between the front and rear walls 110*a,* 110*b*. The space between the front, rear and main sidewalls 110*a,* 110*b,* 110*c* defines the internal cavity of the housing body 110. The rear wall 110*a* is generally structured to include no openings or apertures through which fluid may flow in or out of the housing body 110. In this embodiment, all three sections of the interior cavity of the housing body 110 (i.e., the top, rainwater receiving section, the first rainwater merging, collecting, and diverting section, and the second front rainwater draining section) share the opposing main sidewalls 110*c* of the housing body 110.

The rainwater diverter apparatus 100 is generally structured such that as rainwater flows into the housing body 110 via the inlet 102, the rainwater will be deflected by the water deflector 150 towards one of the first bottom housing section 120 and the second bottom housing section 140. The first bottom housing section 120 is structured to include the primary outlet 122 of the rainwater diverter apparatus 100, while the second bottom housing section 140 is structured to include the water-receiving reservoir 144 of the second bottom housing section 140. The water-receiving reservoir 144 is formed to collect and hold a volume of rainwater that is diverted into the water-receiving reservoir 144 when the water deflector 150 is in the second deflection position. As the rainwater is collected in the water-receiving reservoir 144, rainwater may flow through out at least some of the plurality of secondary outlets 142, towards external reservoirs for collecting the rainwater.

In an embodiment, the water-receiving reservoir 144 of the second bottom housing section 140 is formed within the housing body 110 such that when rainwater is diverted into the water-receiving reservoir 144 at a faster rate than a rate at which rainwater can flow out the plurality of secondary outlets 142, the rainwater within the water-receiving reservoir 144 will rise and spill out of the water-receiving reservoir 144.

In an additional embodiment, the first and second bottom housing sections 120, 140 of the housing body 110 are relatively positioned such that rainwater that spills out of the water-receiving reservoir 144 will flow into the first bottom housing section 120 and through the primary outlet 122. Said another way, the first and second bottom housing sections 120, 140 are structured such that overflow from the water-receiving reservoir 144 of the second bottom housing section 140 will flow out the primary outlet 122 of the first bottom housing section 120 and into the downstream downspout.

In an embodiment such as provided in FIGS. 2A and 2B, the first bottom housing section 120 is formed along a rearward portion of the bottom of the housing body 110 and the second bottom housing section 140 is formed along a forward portion of the bottom of the housing body 110. The first bottom housing section 120 of the housing body 110 includes a substantially horizontal surface 222 along a bottom end of the housing body 110.

In the specific embodiment provided in FIGS. 2A and 2B, the first bottom housing section 120 of the housing body 110 includes a wider, upper portion 610 that tapers into a narrower, lower portion. In some embodiments, the narrower, lower portion of the first bottom housing section 120 is sized such that the downstream portion of the downspout can be received around and secured to the lower portion in a sleeve-like manner for connecting the downstream portion of the downspout to the housing body 110.

In an embodiment such as shown in FIGS. 2A and 2B, the second bottom housing section 140 includes a hollow projection that defines the water-receiving reservoir 144 therewithin, and that projects downwards from the bottom end of the housing body 110. The hollow projection projects downwards to such a level that a bottommost extent the of the water-receiving reservoir 144 is positioned below the substantially horizontal surface 222 of the first bottom housing section 120.

In some embodiments of the housing body 110, a dividing wall is defined between the first bottom housing section 120 and the second bottom housing section 140 of the housing body 110, where the dividing wall acts to separate the first and second bottom housing sections 120, 140.

In an additional embodiment where the housing body 110 includes the dividing wall, the dividing wall is an interior dividing wall that extends across the interior cavity of the housing body 110. In this way, the first bottom housing section 120 of the housing body 110 is defined on a first side of the interior dividing wall and the second bottom housing section 140 of the housing body 110 is defined on an opposing side of the interior dividing wall such that the interior dividing wall separates the first and second bottom housing sections 120, 140. In this embodiment, the housing body 110 is structured such that the water receiving reservoir 144 is defined between one side of the interior dividing wall, the opposing main sidewalls 110*c* of the housing body 110, and the front wall 110*b* of the housing body 110.

Figure 6B:
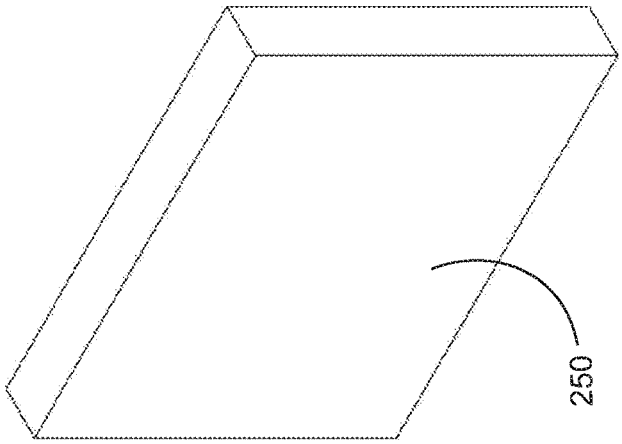
FIG. 6B shows an embodiment of a blocking wall of the embodiment of the rainwater diverter apparatus of FIG. 1.
Figure 6A:
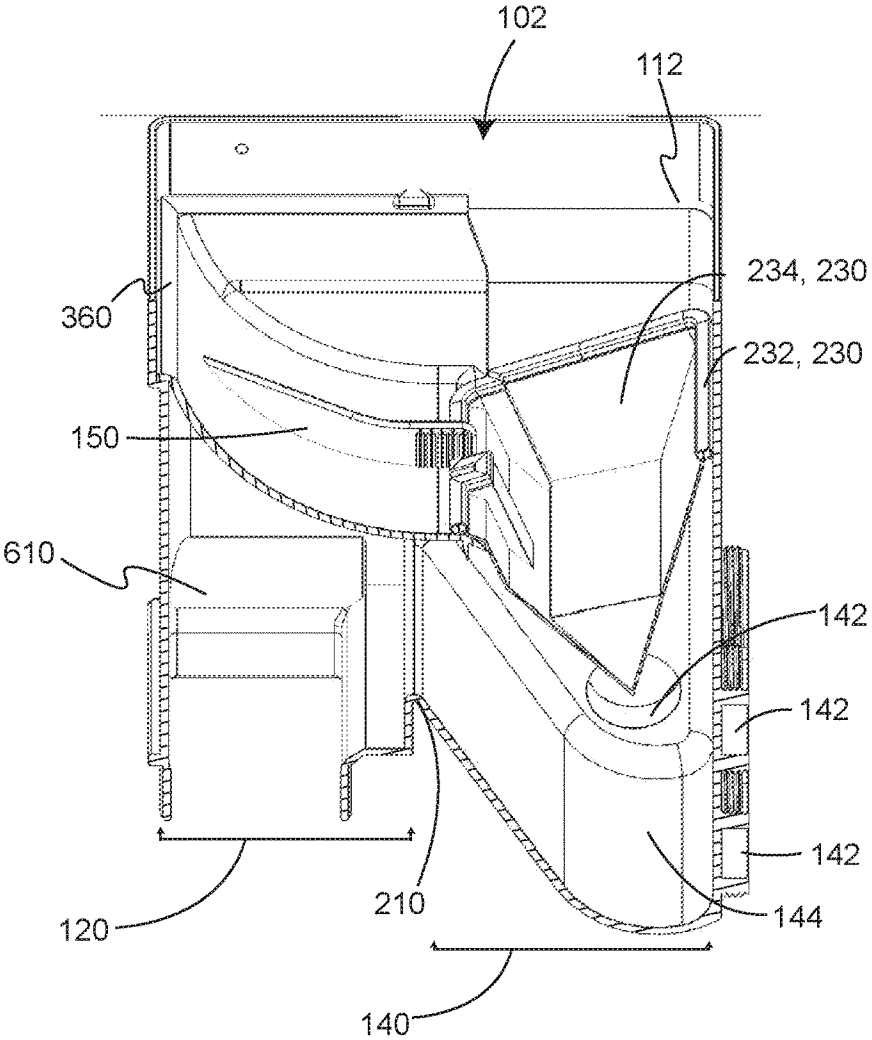
FIG. 6A shows a cut-out-perspective view of the embodiment of the rainwater diverter apparatus of FIG. 2A.
Figure 7A:
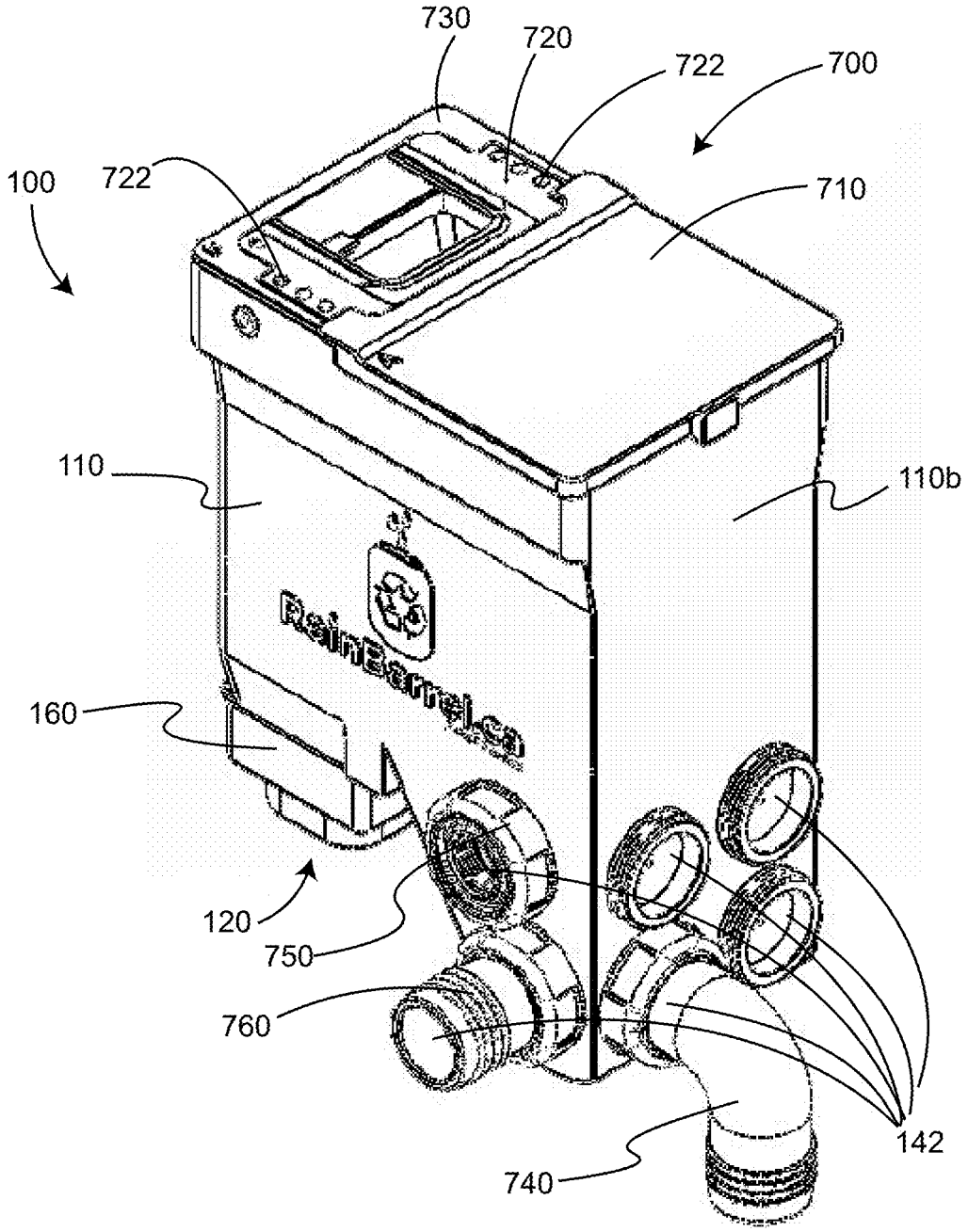
FIG. 7A shows an embodiment of the rainwater diverter apparatus of FIG. 1, where the rainwater diverter apparatus includes a top cover assembly.
Figure 7B:
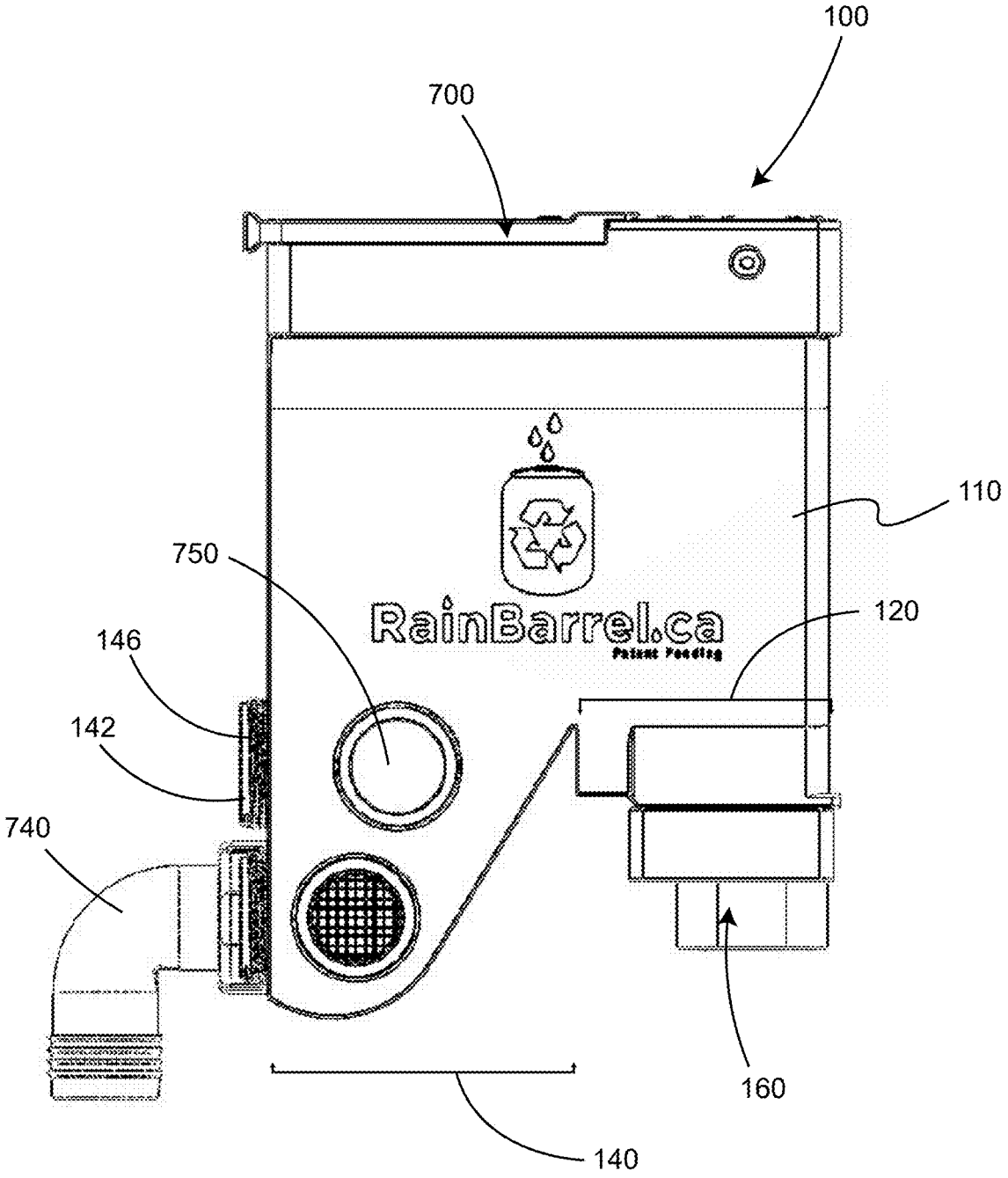
FIG. 7B shows a side view of the embodiment of the rainwater diverter apparatus of FIG. 7A.
Figure 7C:
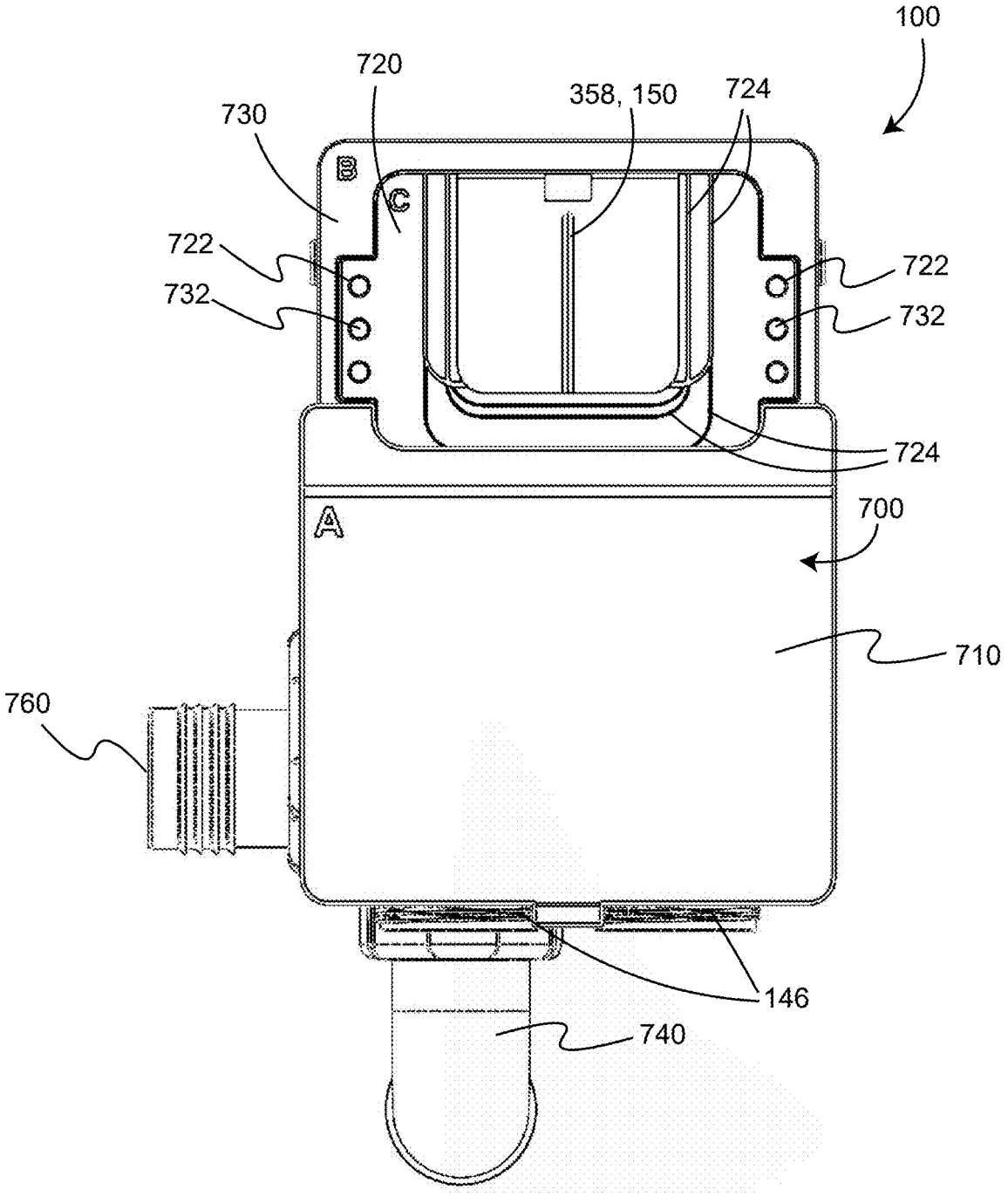
FIG. 7C shows a top view of the embodiment of the rainwater diverter apparatus of FIG. 7A.

In some other embodiments such as shown in FIGS. 2A, 2B and 6A, the first bottom housing section 120 and second bottom section 140 come together to form an apex 210 where no dividing wall is present. Said another way, the housing body 110 includes the apex 210, where the apex 210 separates the first and second bottom housing sections 120, 140. As shown in FIGS. 2A, 2B and 6A, the apex 210 is formed at the intersection of the first and second bottom housing sections 120, 140 and thereby joins the first and second bottom housing sections 120, 140.

In an embodiment, the first bottom housing section 120 of the housing body 110 includes a substantially horizontal surface 222 along a bottom end of the housing body 110, and the second bottom housing section 140 includes the hollow projection that defines the water-receiving reservoir 144. In this embodiment, the apex 210 of the housing body 110 joins the substantially horizontal surface 222 of the first bottom housing section 120 and at least one wall of the hollow projection of the second bottom housing section 140.

In an additional embodiment such as shown in FIGS. 2A, 2B and 6A, a portion of at least one of the first and second bottom housing sections 120, 140 of the housing body 110 that is proximate the apex 210 is formed as an angled portion that is angled downwards so as to ensure any rainwater droplets that fall onto the apex 210 are still collected and do not accumulate on the apex 210.

In the specific embodiment provided in Figure FIGS. 2A, 2B and 6A, the apex 210 is formed as a rounded apex. The first bottom housing section 120 of the housing body 110 includes the substantially horizontal surface 222, and a substantially vertical surface 224 that extends upwards therefrom. The second bottom housing section 140 includes a sloped wall 242 that extends between the apex 210 of the housing body 110 and the front wall 110*b* of the housing body 110. The sloped wall 242 is formed to slope down from the apex 210 of the housing body 110, both toward the front wall 110*b* of the housing body 110 and downwards, towards the bottom of the water-receiving reservoir 144. The sloped wall 242 includes a downwardly angled section 242*a* proximate the apex 210 which progresses into a curved section 242*b* that forms a bottommost extent of the second bottom housing section 140.

In this embodiment, the hollow projection of the second bottom housing section 140 is defined by the sloped wall 242, the opposing main sidewalls 110*c* of the housing body 110 and the front wall 110*b* of the housing body 110.

Figure 3C:
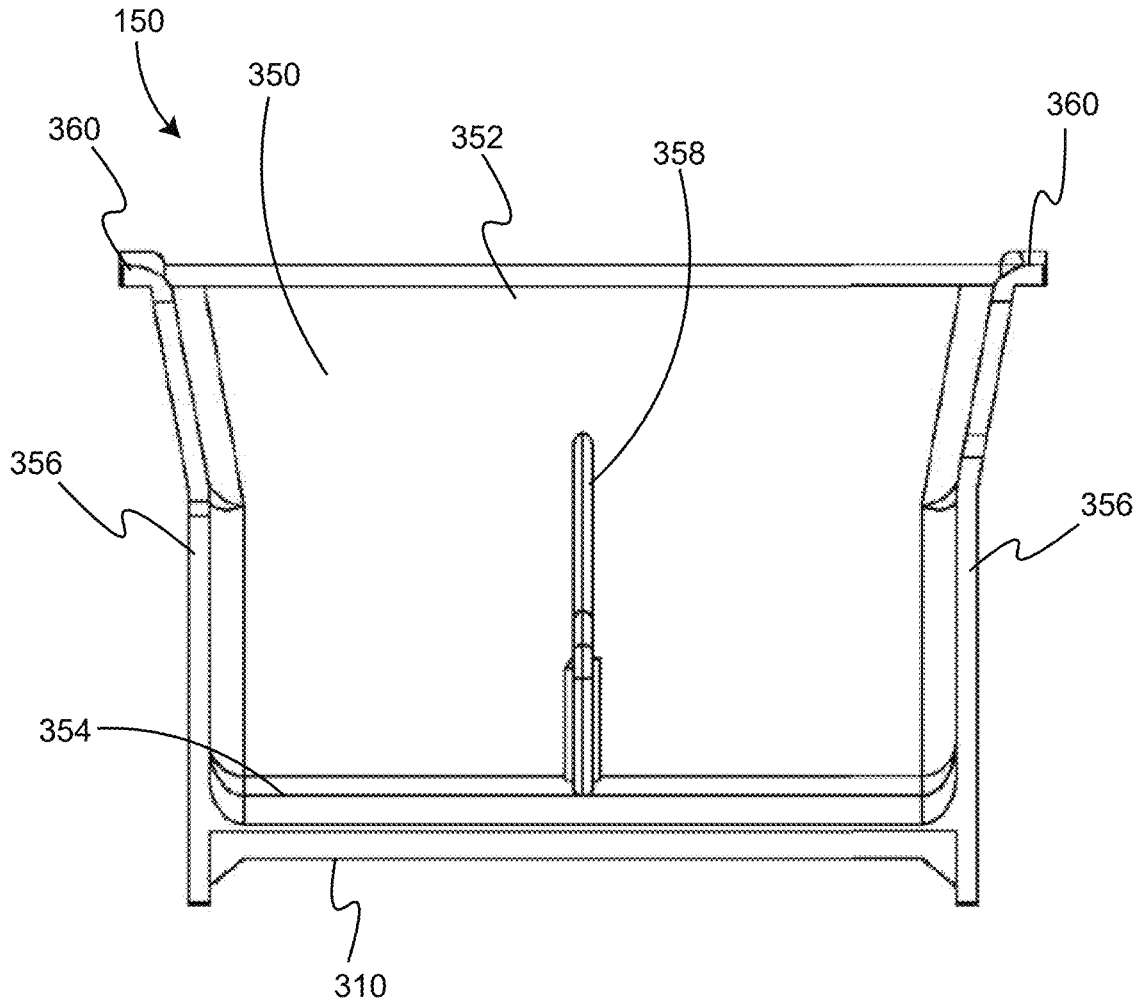
FIG. 3C shows a front view of the embodiment of the water deflector of FIG. 3A.
Figure 4A:
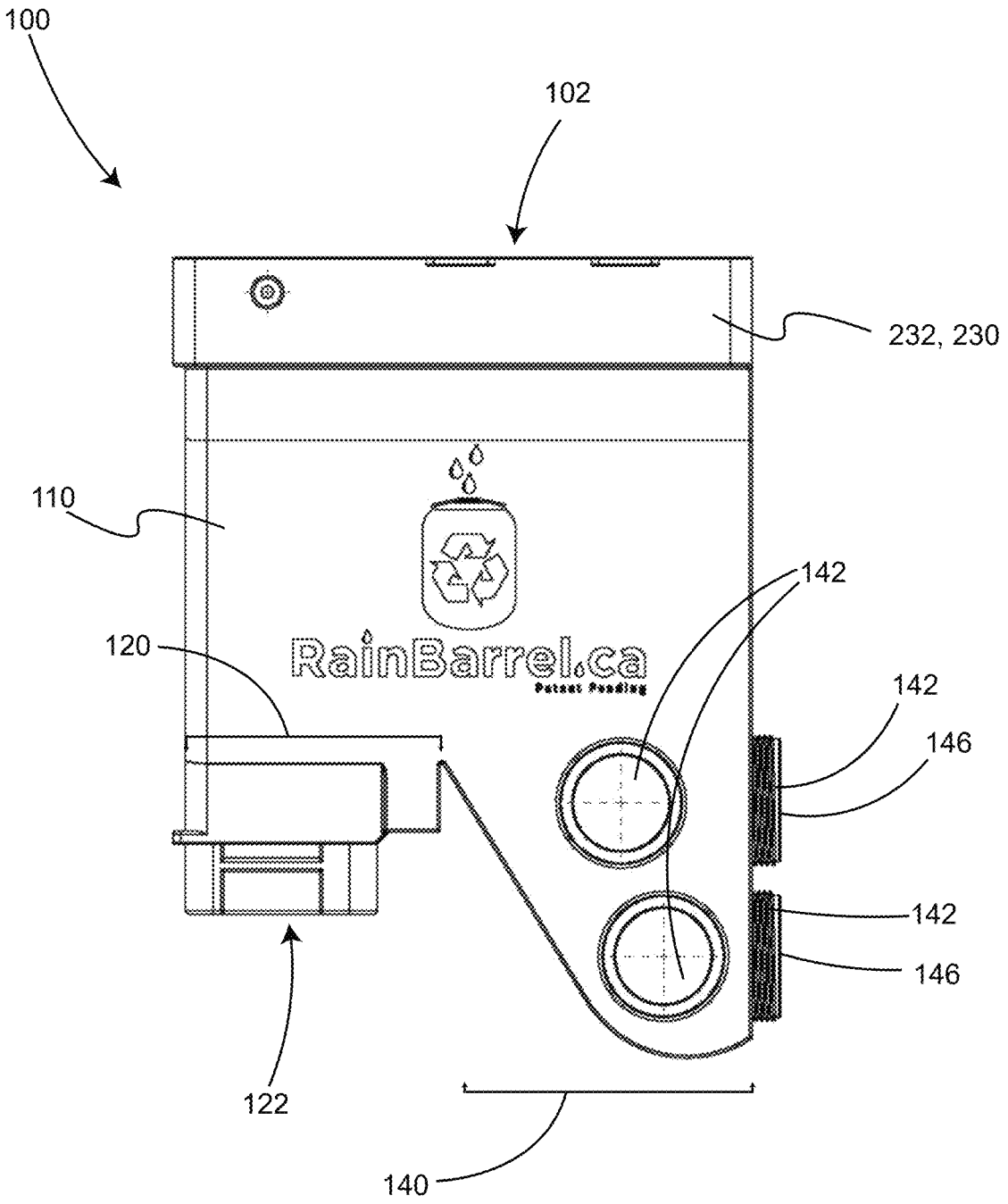
FIG. 4A shows a first side view of the embodiment of the rainwater diverter apparatus of FIG. 1.
Figure 4B:
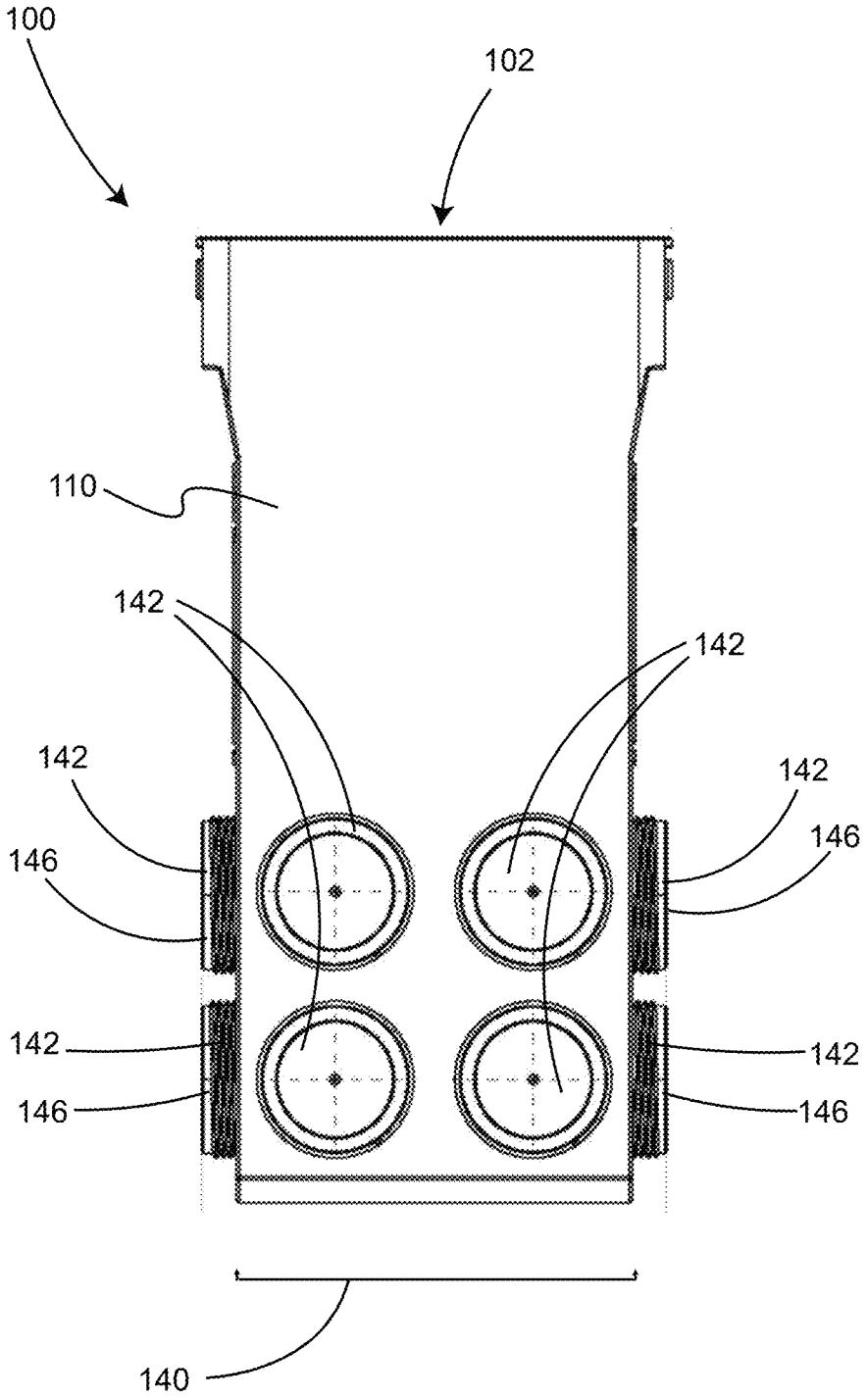
FIG. 4B shows a front view of the embodiment of the rainwater diverter apparatus of FIG. 1.
Figure 4C:
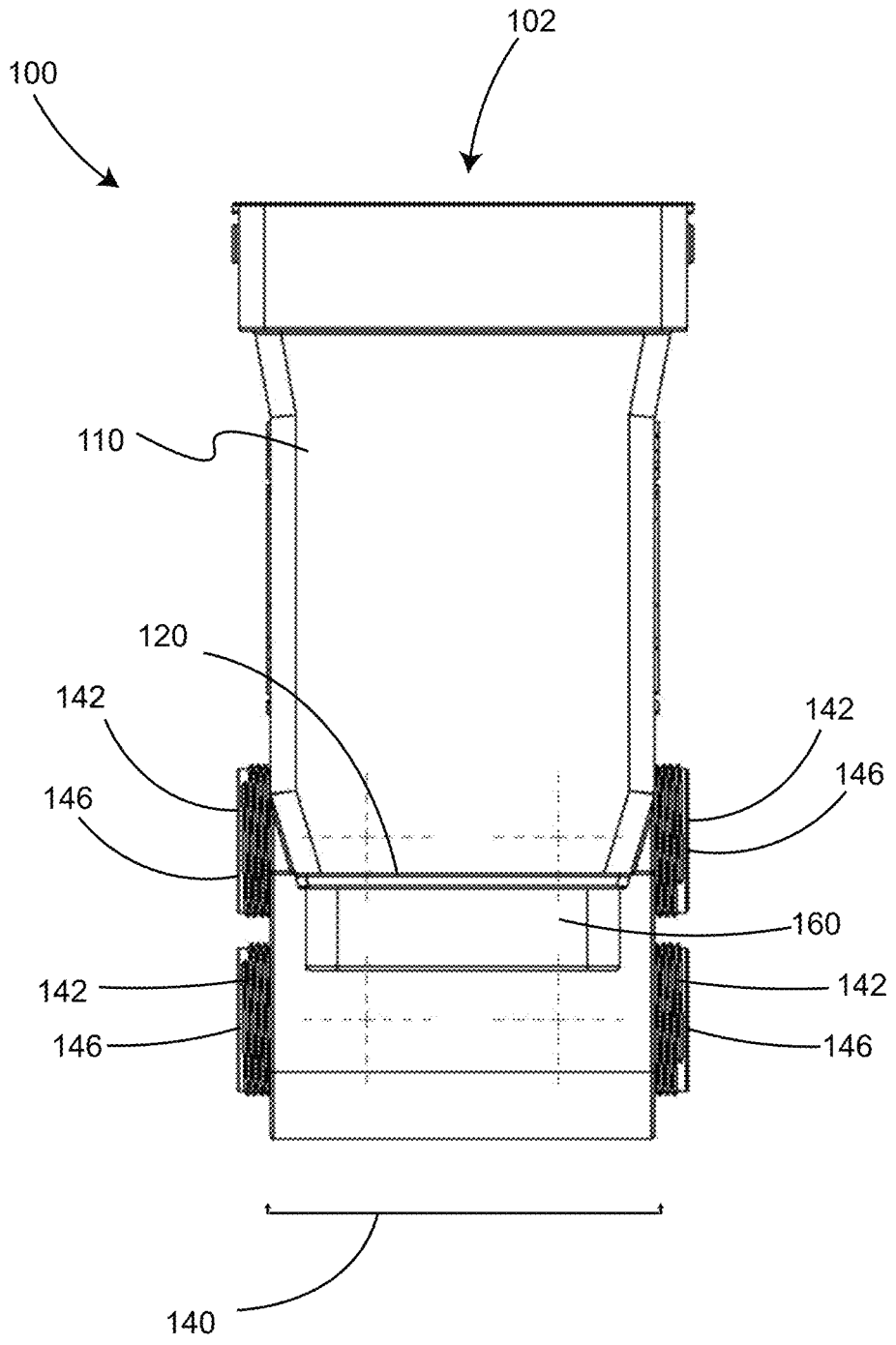
FIG. 4C shows a rear view of the embodiment of the rainwater diverter apparatus of FIG. 1.
Figure 5A:
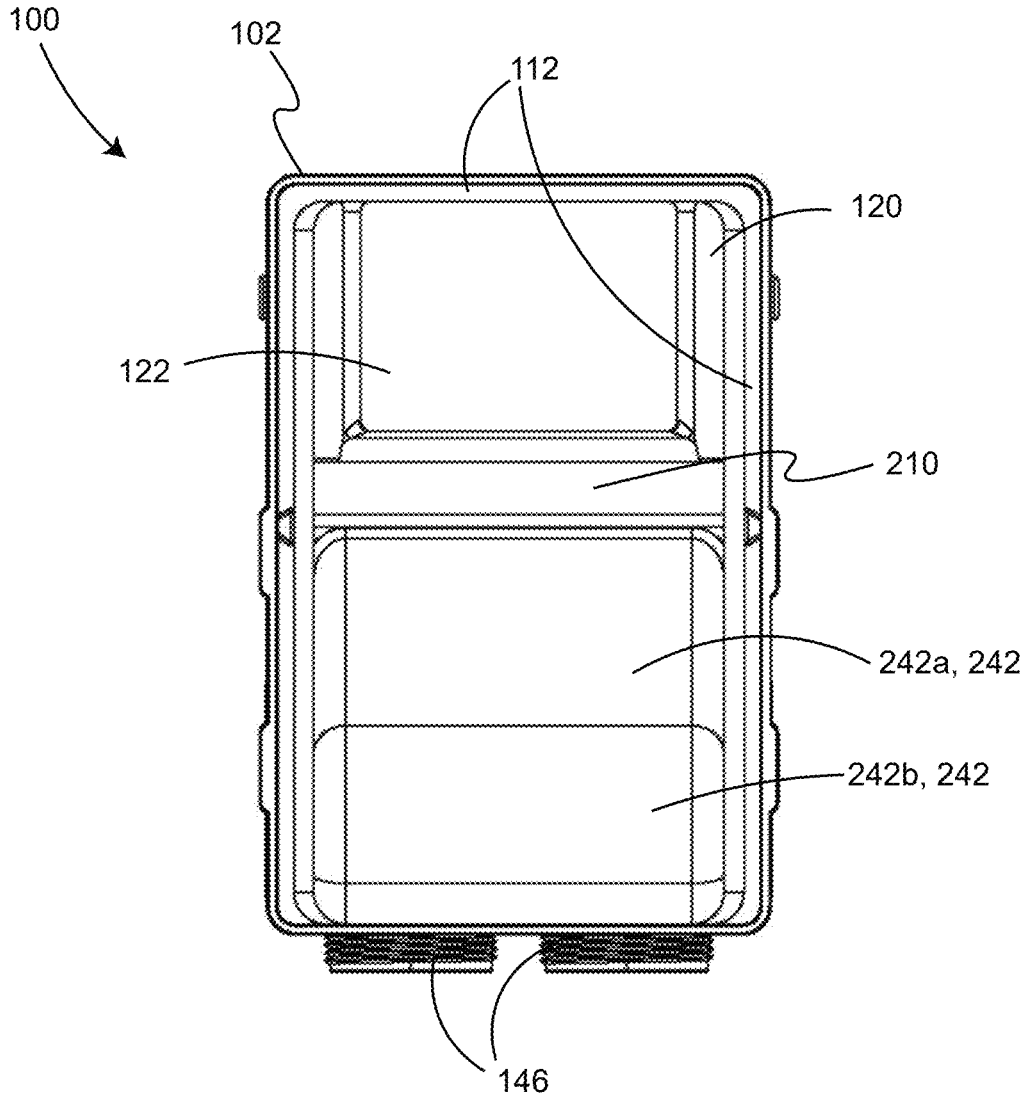
FIG. 5A shows a top view of the embodiment of the rainwater diverter apparatus of FIG. 1.
Figure 5B:
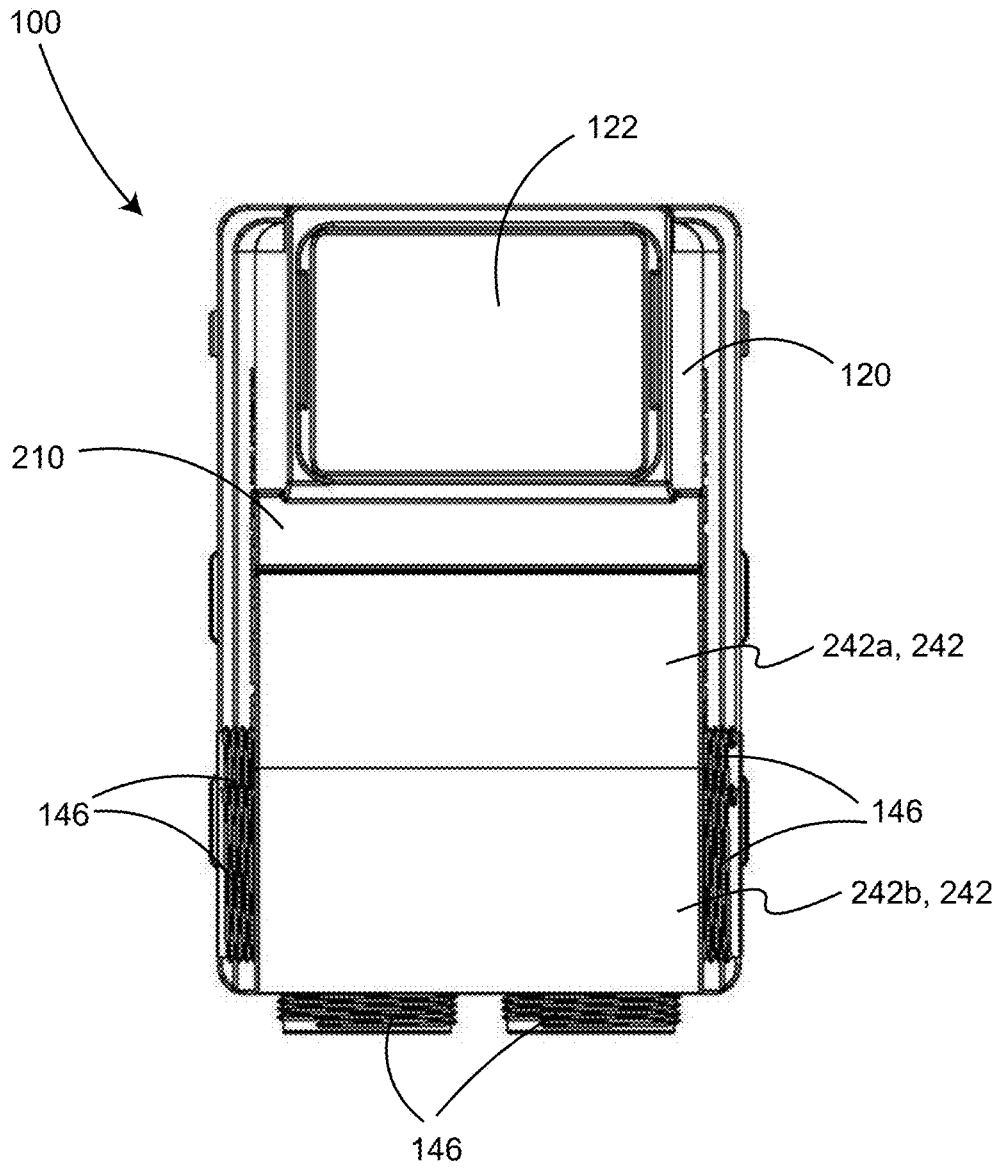
FIG. 5B shows a bottom view of the embodiment of the rainwater diverter apparatus of FIG. 1.

In an embodiment such as shown in FIGS. 3A to 3C, the water deflector 150 includes an upstream end 352, a downstream end 354, and a deflecting surface 350 extending between the upstream and downstream ends 352, 354 that is structured for deflecting rainwater. As provided above, the water deflector 150 of the rainwater diverter apparatus 100 is structured to be positioned in both first and second deflection positions. As shown in FIG. 2A, when the water deflector 150 is in the second deflection position, the water deflector 150 is structured to fit below the inlet 102 of the housing body 110, where it redirects rainwater from the inlet 102 into the water-receiving reservoir 144 of the rainwater diverter apparatus 100. As shown in FIG. 2B, when the water deflector 150 is in the first deflection position, the water deflector 150 is positioned more towards the front wall 110*b* of the housing body 110 than in the second deflection position and does not impede the flow of rainwater from the inlet 102 of the housing body 110 to the primary outlet 122. In the first deflection position, the water deflector 150 is positioned with the upstream end 352 of the water deflector 150 proximate the front wall 110*b* of the housing body 110 such that any rainwater from the inlet 102 that travels in the direction of the water-receiving reservoir 144 will instead be deflected towards the primary outlet 122.

In an embodiment, the water deflector 150 is formed such that when the water deflector 150 is mounted in either of the first or second deflection positions within the housing body 110, the upstream end 352 of the water deflector 150 will be positioned at a higher vertical point than the downstream end 354 of the water deflector 150 for deflecting rainwater along the deflecting surface 350 of the water deflector 150 under the influence of gravity.

In the specific embodiment provided in FIGS. 3A to 3C, the deflecting surface 350 is an arcuate deflection slide that curves downwards between the upstream and downstream ends 352, 354 of the water deflector 150 such that the upstream end 352 of the water deflector 150 is positioned above the downstream end 354. The water deflector 150 also includes a pair of side walls 356 that are disposed on opposing lateral sides of the deflecting surface 350, and a handle element 358 that is centrally disposed along a portion of the water deflecting surface 350 such that the handle element 358 extends from the downstream end 354 of the water deflector 150 towards the upstream end 352. The handle element 358 includes a ribbed grip surface along a portion thereof.

In an embodiment, the water deflector 150 is structured as a removable water deflector 150 that can be removed from within the interior cavity of the housing body 110 and manipulated into either the first deflection position or the second deflection positions. Said another way, the water deflector 150 is removably mountable within the interior of the housing body 110, at least partly below the inlet 102, in either the first deflection position for deflecting rainwater towards the primary outlet 122 or the second deflection position for deflecting rainwater towards the water-receiving reservoir 144.

By providing the water deflector 150 as a rigid, removable unit that can be fully separated from the housing body 110 of the rainwater diverter apparatus 100, the water deflector 150 has a reduced exposure to water at any mating seams between the water deflector 150 and the housing body 110, which in turn reduces the susceptibility of the water deflector 150 to sticking due to ice and debris buildup between the water deflector 150 and the housing body 110.

In an additional embodiment, the water deflector 150 includes at least one first connector element, and the housing body 110 includes at least one second connector element. The at least one first connector element is connectable to the at least one second connector element for connecting the water deflector 150 to the housing body 110. The first and second connector elements are structured such that the water deflector 150 is position-able in either the first or second deflection positions when connected to the housing body 110.

In an embodiment such as shown in FIGS. 1, 3A, 3B and 3C, the housing body 110 includes a support lip 112 that is formed along at least one interior surface of the housing body 110, and the water deflector 150 includes an abutting edge 360. The abutting edge 360 of the water deflector 150 is sized to be received and supported on the support lip 112 of the at least one interior surface of the housing body 110 for removably mounting the water deflector 150 in each of the first or second deflection positions. In this way, the support lip 112 of the housing body 110 defines the at least one second connector element, and the abutting edge 360 of the water deflector 150 defines the at least one first connector element that is connectable to the second connector element.

In the specific embodiment shown in FIGS. 1 to 3C, the water deflector 150 includes the pair of side walls 356 that are disposed on opposing lateral sides of the deflecting surface 350 of the water deflector 150, and the abutting edge 360 of the water deflector 150 is formed along each of the pair of side walls 356 and the upstream end 352 of the water deflector 150. The support lip 112 of the housing body 110 is formed along an interior surface of each of the front wall 110*b*, rear wall 110*a* and opposing main sidewalls 110*c* of the housing body 110. In this way, the abutting edge 360 of the water deflector 150 will rest along the support lip 112 of the housing body 110 when the water deflector 150 is positioned in both the first deflection position (see FIG. 2B) and the second deflection position (see FIG. 2A).

In this same embodiment, the support lip 112 of the housing body 110 includes a pair of check blocks 114 formed on opposing lateral sides of the support lip 112. Each check block 114 of the pair of the check blocks 114 is formed to engage a portion of the water deflector 150 when the water deflector 150 is supported on the support lip 112 (in either the first deflection position or second deflection position) so as to keep the water deflector securely engaged on the support lip 112, especially in instances where the water passing through the inlet 102 of the housing body 110 is flowing at a relatively high speed.

In an additional embodiment, the water deflector 150 includes a pair of receiving recesses 312 that are each shaped to receive one of the pair of check blocks 114 when the water deflector 150 is supported on the support lip 112. The pair of receiving recesses 312 are positioned on the water deflector 150 such that the pair of check blocks 114 can be received in the pair of receiving recesses 312 when the water deflector 150 is in either the first deflection position or the second deflection position.

As provided above, the underside of the water deflector 150 includes the deflecting lip 310 for inhibiting the movement of rainwater up the underside of the water deflector 150. The deflecting lip 310 can be formed as a separate body that is connected to the underside of the water deflector 150, or it can be integrally formed with the underside of the water deflector 150.

In an additional embodiment, the deflecting lip 310 of the rainwater deflector 150 is sized such that when the water deflector 150 is mounted in either the first or second deflection position and the filter element 230 is connected between the water deflector 150 and the housing body 110, a bottommost extent of the deflecting lip 310 will extend beyond a bottommost extent of the filter element 230 such that any rainwater which passes through along the deflecting lip 310 will be guided against the filter element 230.

In an embodiment such as shown in FIGS. 2A, 2B and 6A, the rainwater diverter apparatus 100 further includes a filter element 230 that is connectable between the housing body 110 and the water deflector 150, when the water deflector 150 is in either of the first or second deflection positions, for capturing debris from rainwater that is deflected by the water deflector 150.

In an additional embodiment, the filter element 230 includes a filter holder 232 that is connectable between the housing body 110 and a portion of the water deflector 150 that is proximate the downstream end 354 of the water deflector 150. The filter element 230 also includes a filter material that is mountable within the filter holder 232 and that is structured for catching the debris from the rainwater deflected by the water deflector 150.

In the specific embodiment provided in FIGS. 2A, 2B and 6A, the filter material is a filter screen 234. The filter screen 234 is structured to attached to the handle element 358 of the water deflector 150 such that fast-flowing rainwater that is deflected along the deflecting surface 350 of the water deflector 150 will not dislodge the filter screen 234. The handle element 358 has a notched grip surface and the filter screen 234 has two small protrusions that are releasably received into the notched grip of the handle element 358.

In an additional element, the filter screen 234 is structured as a mosquito and debris filter basket.

In some embodiments of the rainwater diverter apparatus 100, the entire top end of the housing body 110 is open such that the entire top end defines the inlet 102 of the housing body 110.

In an alternative embodiment such as shown in FIGS. 5A to 5B and 7A to 7C, the rainwater diverter apparatus 100 includes a top cover assembly 700 with a through-aperture that is connectable to the upstream downspout. The top cover assembly 700 of the rainwater diverter apparatus 100 is structured to be connected to the housing body 110 so as to define a top end of the housing body 110. The through-aperture of the top cover assembly 700 defines the inlet 102 of the housing body 110 through which rainwater is received from the upstream downspout.

In an additional embodiment, the top cover assembly 700 is structured for varying a size of the through-aperture of the top cover assembly 700 such that a size of the inlet 102 of the housing body 110 can be adjusted for connecting the inlet 102 of the housing body 110 to various sizes of upstream downspouts.

In an embodiment such as shown in FIGS. 5A, 5B and 7A to 7C, the top cover assembly 700 includes a plurality of adjustable panels. Some or all of the top panels can be connected together to form the top cover assembly 700 that defines the top end of the housing body 110.

In the specific embodiment provided in Figure FIGS. 5A to 5B and 7A to 7C, the plurality of adjustable panels of the top cover assembly 700 includes three mechanically separable panels. When assembled to form the top cover assembly 700, the top cover assembly 700 will be connectable along the opposing main sidewalls 110*c* and the front wall 110*b* of the housing body 110, while leaving a sufficiently large through aperture proximate the rear wall 110*a* of the housing body 110 to receive an upstream downspout therewithin.

In an additional embodiment such as shown in FIGS. 8A to 8D, the three mechanically separable panels include a front panel 710, middle panel 720 and rear panel 730. The middle panel 720 includes a u-shaped flange and plurality of apertures formed on opposing sides of the u-shaped flange. The rear panel 730 includes a u-shaped body and a plurality of connecting projections formed on opposing lateral sides of the u-shaped body. The plurality of connecting projections are sized to be received in the plurality of apertures of the middle panel 720 such that the middle and rear panel 720, 730 can be removably connected together. The middle and rear panel 720, 730 are structured such that when removably connected, the u-shaped flange of the middle panel 720 and the u-shaped body of the rear panel 730 will collectively define the through-aperture of the top cover assembly 700. The rear panel 730 of the top cover assembly 700 is structured to minimize gaps between the upstream downspout, and the middle and front panel 710 sections. The front panel 710 is structured so as to be slidable connectable to one of the rear and middle panels 720, 730 via a securing flange 712, where the front panel 710 is slid into place along the one of the rear and middle panels 720, 730 and is connected in place via the securing flange 712.

In an additional embodiment, the top end of the housing body 110 (i.e., the top cover assembly 700) includes at least one cut-line 724 that is structured to be cut for removing at least one section of the top end of the housing body 110. The cut-line 724 is formed on the top end of the housing body 110 such that removing the at least one section of the top end increased the size of the inlet 102 such that the inlet 102 can receive a larger sized upstream downspout.

Figure 8A:
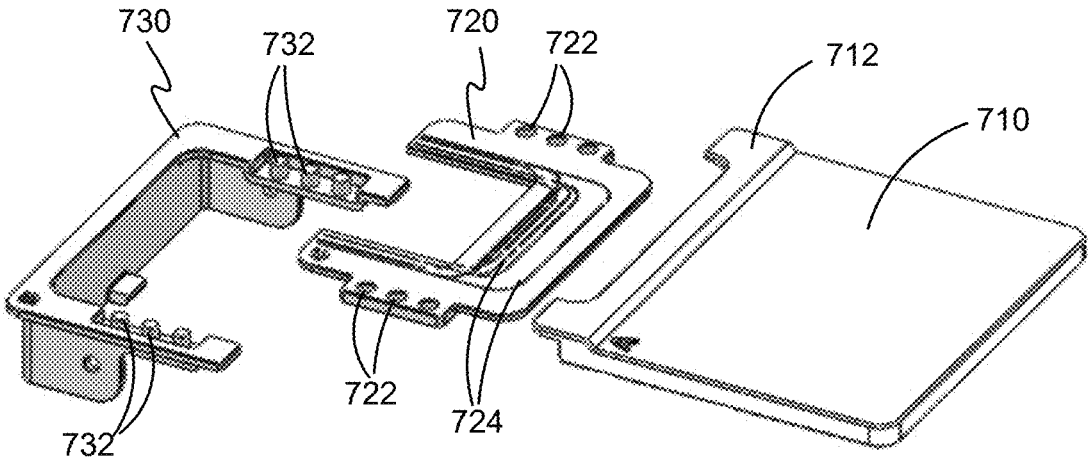
FIG. 8A shows an exploded perspective view of the top cover assembly of the embodiment of the rainwater diverter apparatus in FIG. 7A.
Figure 8B:
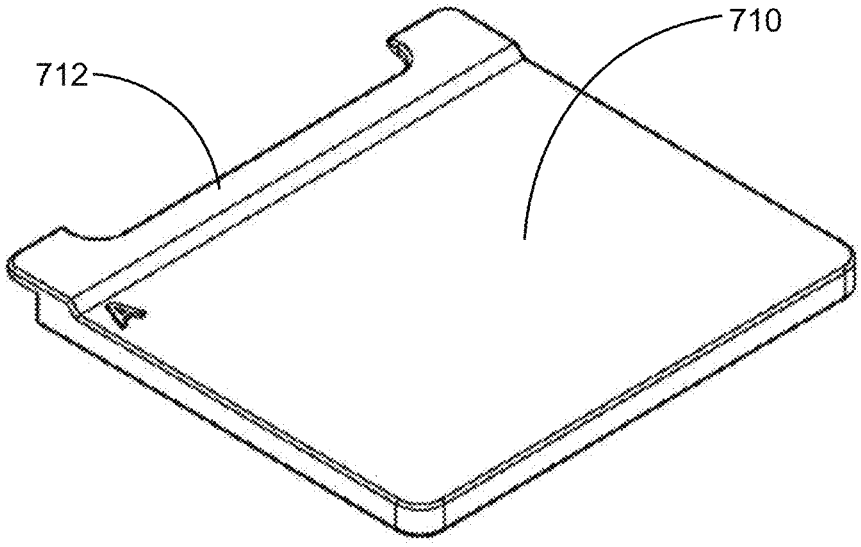
FIG. 8B shows a perspective view of the front panel of the top cover assembly of FIG. 8A.
Figure 8C:
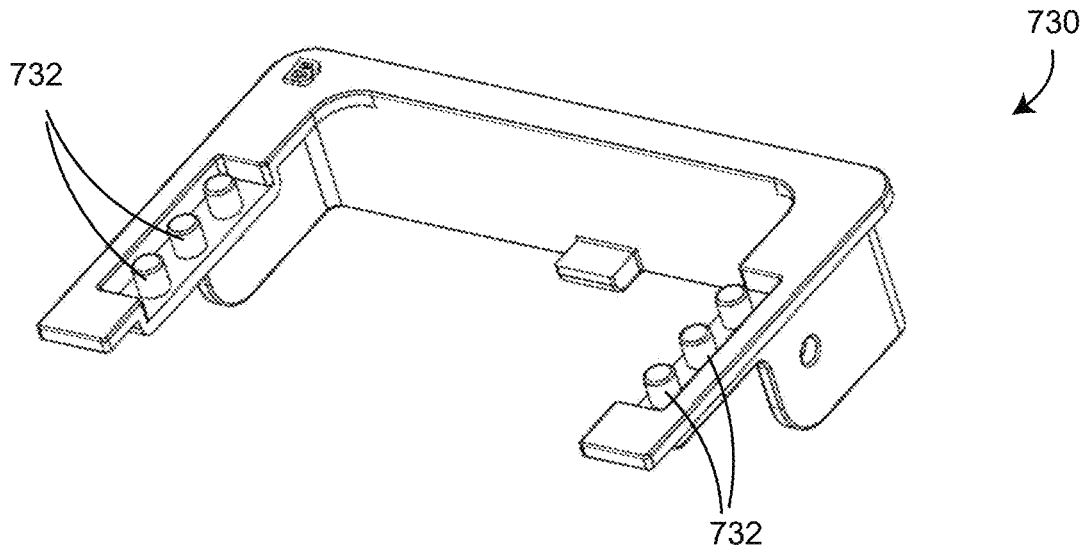
FIG. 8C shows a perspective view of the rear panel of the top cover assembly of FIG. 8A.
Figure 8D:
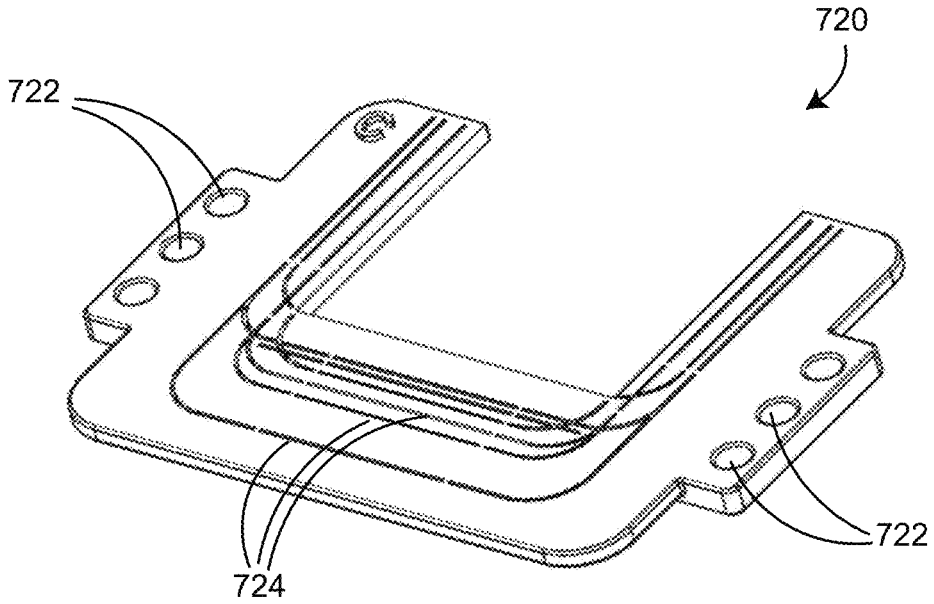
FIG. 8D shows a perspective view of the middle panel of the top cover assembly of FIG. 8A.

In the specific embodiment provided in FIGS. 8A and 8D, the at least one cut line of the top end of the housing body 110 is formed on the middle panel 720 of the top cover assembly 700. The at least one cut line on the middle panel 720 is a plurality of cut-lines 724 that correspond to various downspout sizes.

In an embodiment, the top end of the housing body 110 is structured such that the inlet 102 of the housing body 110 will receive a standard sized downspout prior to any cutting of the cut-lines 724 and removal of the at least one section of the top end. For downspout sizes which are larger than this standard size, the cut-lines 724 on the middle panel 720 will need to be cut in order to fit the upstream downspout and to achieve the best fit.

In an additional embodiment such as shown in FIGS. 2B, 6A and 6B, the rainwater diverter apparatus 100 further comprises a blocking wall 250 that is structured to be connected between the underside of the water deflector 150 and the apex 210 of the housing body 110 for fluidly separating a portion of the housing body 110 above the first bottom housing section 120 and another portion of the housing body 110 above the second bottom housing section 140.

In the specific embodiment provided in FIGS. 2A, 6A and 6B, the blocking wall 250 is structured as a rectangular wall and is sized such that when the blocking wall 250 is connected between the underside of the water deflector 150 and the apex 210 of the housing body 110, the blocking wall 250 is substantially vertical. The blocking wall 250 is formed such that an upper end of the blocking wall 250 abuts the second side 310*b* of the deflecting lip 310 when the blocking wall 250 is connected between the underside of the water deflector 150 and the apex 210 of the housing body 110. The blocking wall 250 can be provided with connectors for connecting the blocking wall 250 between the underside of the water deflector 150 and the apex 210 of the housing body 110, or the blocking wall 250 can be sized to be wedged between the underside of the water deflector 150 and the apex 210 of the housing body 110 for connecting the blocking wall 250 in place.

In an additional embodiment, the blocking wall 250 is formed as the foam blocking wall that is composed of at least one waterproof material.

In an additional, alternate embodiment, the blocking wall 250 is formed as a foam blocking wall that is composed of at least one water-absorbent, foam material.

In an additional embodiment, an interior surface of at least some of the opposing main sidewalls 110*c*, front wall 110*b* and rear wall 110*a* of the housing body 110 are structured to be at least partially sloped from the top towards the bottom of the housing body 110. By structuring the at least some of the opposing main sidewalls 110*c*, front wall 110*b* and rear wall 110*a* to be sloped in this way, the structure of the housing body 110 will minimize the impediment of the gravitational velocity of rainwater entering through the inlet 102 in the top end of the housing, thereby promoting a self-flushing operating capacity of the rainwater diverter apparatus 100.

In another additional embodiment, the housing body 110 includes at least one limit block to limit the extent to which an upstream downspout can be inserted into the housing body.

In an additional embodiment, the at least one limit block is a pair of limit blocks formed on the inside surface of each of the opposing main sidewalls 110*c*, proximate the top end of the housing body 110. The pair of limit blocks are positioned below the inlet 102 of the housing body 110 so as to limit the extent to which the upstream downspout can be inserted into the housing body 110 when the upstream downspout is received into the inlet 102 of the housing body 110. The limit blocks extend into the interior cavity of the housing body 110 at an appropriate minimal distance to form a physical, internal limitation within the cavity so as to prevent the upstream downspout (which is received in the inlet 102 of the housing body 110) from further entering the interior cavity, while still permitting the upstream downspout to enter the interior cavity at a sufficient depth so as to provide an anchoring mechanism for securing the upstream downspout to the rainwater diverter apparatus 100.

While the above embodiment specifically describes a structure of the rainwater diverter apparatus 100 that includes a pair of limit blocks, it will be readily understood that various structures of the limit blocks could be provided for limiting the insertion of the upstream downspout beyond the inlet 102 of the housing body 110. For example, limit blocks could be formed as a single limit block that is formed on a rear, central location on the rear panel 730. In this exemplary embodiment, the upstream downspout will rest on the single limit block. The single limit block is also capable of supporting a centrally-located, round upstream downspout.

The rainwater diverter apparatus 100 as disclosed herein may also be structured such that the housing body 110 of the rainwater diverter apparatus 100 will provide optimal or preferred flow conditions as the rainwater is diverted through the rainwater diverter apparatus 100.

In an embodiment of the rainwater diverter apparatus 100 such as shown in FIGS. 1 to 2B, 4A to 5B and 7A to 7C, the plurality of secondary outlets 142 that are fluidly connectable to at least one external collection reservoir and that are positioned on at least one sidewall of the second bottom housing section 140 of the housing body 110. As provided above, the rainwater diverter apparatus 100 includes the housing body 110 with the inlet 102 that is shaped to interface with the upstream portion of downspout for fluidly connecting the housing body 110 and the downspout. In this same embodiment, the inlet 102 of the housing body 110 is sized such that a cross-sectional area of the inlet 102 is substantially equivalent to a cross-sectional area of the primary outlet 122. By relatively sizing the inlet 102 and primary outlet 122 in this way, the bottlenecking of rainwater flowing through the primary outlet 122 is substantially inhibited. The inlet 102 of the housing body 110 is also sized such that the cross-sectional area of the inlet 102 is substantially equivalent to a combined cross-sectional area of the plurality of secondary outlets 142 such that the bottlenecking of rainwater flowing through the plurality of secondary outlets 142 is substantially inhibited. By providing a cross-sectional area of the inlet 102 of the housing body 110 that is substantially equivalent to each of the area of the primary outlet 122 and the combined area of all of the plurality of secondary outlets 142, the potential for bottlenecking of rainwater within the housing body 110 of the rainwater diverter apparatus 100 will be greatly reduced.

While the above embodiments are specific to the cross-sectional area of the inlet 102 being substantially equivalent to each of the cross-sectional area of the primary outlet 122 and the combined cross-sectional area of the plurality of secondary outlets 142, other embodiments of the rainwater diverter apparatus 100 may be configured such that the cross-sectional area of the inlet 102 is less than or equal to each of the cross-sectional area of the primary outlet 122, and the combined cross-sectional area of the plurality of secondary outlets 142. In these embodiments, the relative sizing of the inlet 102, primary outlet 122 and plurality of secondary outlets 142 is still such that the bottlenecking of rainwater flowing through the primary outlet 122 or the plurality of secondary outlets 142 is substantially inhibited.

In an additional embodiment, the rainwater diverter apparatus 100 is structured such that a cross-sectional area of the inlet 102 of the housing body 110 is substantially equivalent to a cross-sectional area of the top, rainwater receiving section of the housing body 110 such that any bottlenecking of rainwater that is flowing through the inlet 102 of the housing body 110 is substantially inhibited.

In another, additional embodiment, the housing body 110 is sized such that a cross section of the interior of the housing body 110 proximate the inlet 102 of the housing body 110 is greater than or equal to a cross section of the upstream downspout for inhibiting the backup of rainwater entering the housing body 110 through the upstream downspout.

As shown in FIGS. 1 to 2B, 4A to 5B and 7A to 7C, the housing body 110 also includes the primary outlet 122 that is formed in the first bottom housing section 120 of the housing body 110 and that is shaped to interface with a downstream portion of the downspout.

Figure 9A:
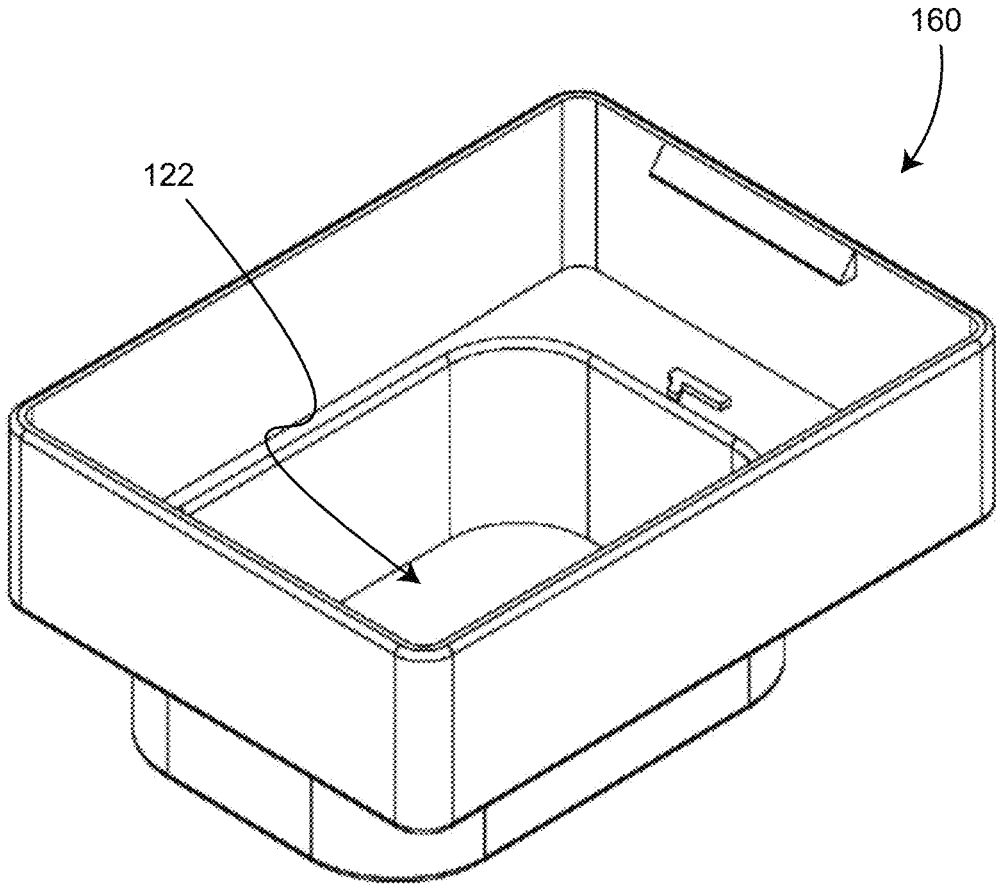
FIG. 9A shows a perspective view of the removable reducer section of the rainwater diverter apparatus of FIG. 1.
Figure 9B:
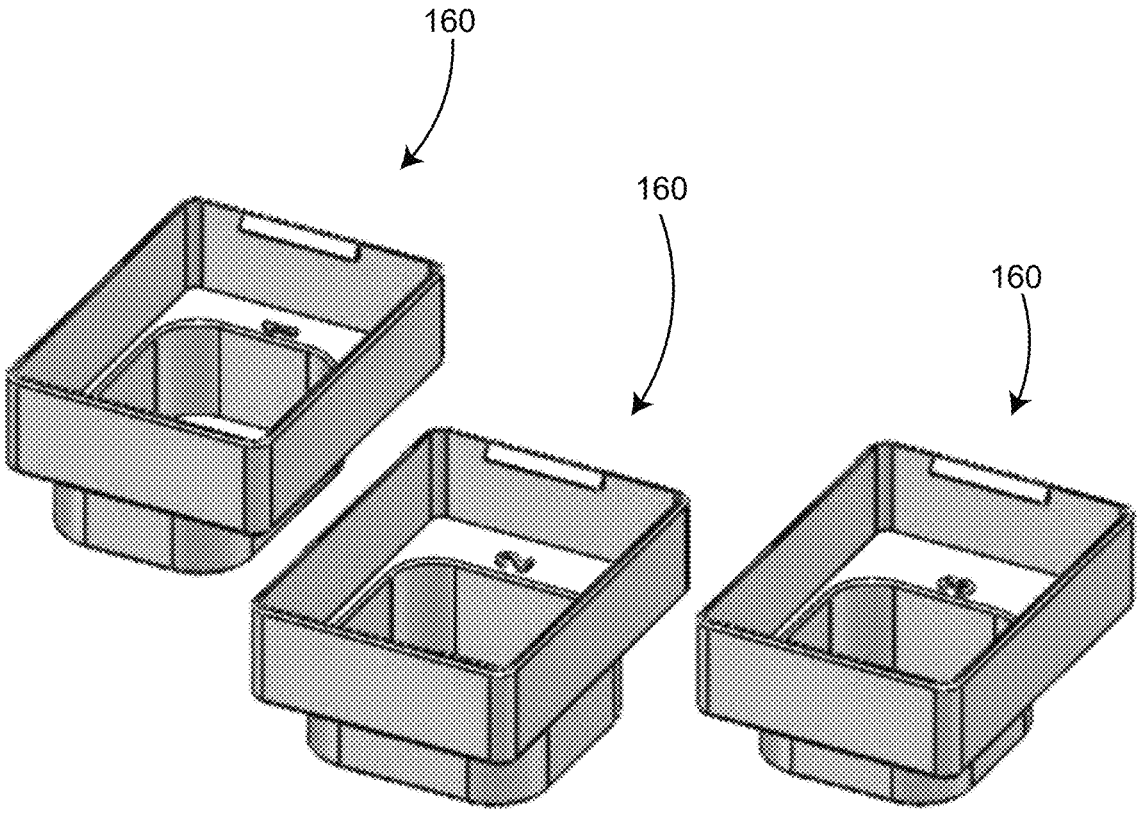
FIG. 9B shows a plurality of sizes of the removable reducer section of the rainwater diverter apparatus of FIG. 1.

In an additional embodiment such as shown in FIGS. 1, 7A, 7B and 9A, the first bottom housing section 120 includes a removable reducer section 160 that forms the narrower, lower portion or the first bottom housing section 120, and which defines the primary outlet 122 therethrough. The removable reducer section 160 makes up at least a portion of the first bottom housing section 120 and is removably connectable to the housing body 110. The rainwater diverter apparatus 100 can include various sizes of removable bypass section (such as shown in FIG. 9B) with varying sizes of primary outlet 122 formed therethrough may be attached to the housing body 110 so as to accommodate a variety of downstream downspout dimensions and to eliminate the potential for flow reduction through the primary outlet 122 of the housing body 110.

In an embodiment, the wider, upper portion 610 of the first bottom housing section 120 is structured such that the removable reducer section 160 can be removably connected thereto. In this embodiment, the wider, upper portion 610 also includes an opening formed therethrough that will define the primary outlet 122 of the first bottom housing section 120 if no removable reducer section 160 is attached to the housing body 110.

In an exemplary embodiment, the wider, upper portion 610 of the first bottom housing section 120 is structured to receive a 3×4" downstream downspout. If the downstream downspout is 3×4" or if the downstream downspout is round and can be squeezed to fit over the 3×4" opening of the wider, upper portion 610 of the first bottom housing section 120, then the removable reducer section 160 will not be required. If the downspout is smaller than 3×4", a removable reducer section 160 will be required. Where a removable reducer section 160 is required, a user can identify the largest removable reducer section 160 that will fit into the downstream downspout and the removable reducer section 160 is connected over the opening of the wider, upper portion 610 of the first bottom housing section 120.

In an additional embodiment, the wider, upper portion 610 of the first bottom housing section 120 includes a number of side grooves, and the removable reducer section 160 includes a number of interior, side hooks. When connecting the wider, upper portion 610 of the first bottom housing section 120 with the removable reducer section 160, the side hooks are inserted into the side grooves before snapping the removable reducer section 160 into place over the opening in the wider, upper portion 610 of the first bottom housing section 120.

The removable reducer section 160 may have various forms or structures depending on the structure of the downstream downspout and/or the form of the primary outlet 122 of the first bottom housing section 120. For example, the removable reducer section 160 can be formed at various sizes so as to accommodate varying sizes of downstream downspouts. Similarly, the removable reducer section 160 can have a round or rectangular form.

In an additional embodiment, the top cover assembly 700 is structured to connect to a top reducer section of the rainwater diverter apparatus 100. Like the removable reducer section 160, the top reducer section is structure to be attached to the housing body 110 (via the top cover assembly 700) so as to accommodate a variety of upstream downspout dimensions and to eliminate the potential for flow reduction through the inlet 102 of the housing body 110.

As provided above, the housing body 110 also includes the plurality of secondary outlets 142 that are fluidly connectable to at least one external collection reservoir and that are positioned on at least one sidewall of the second bottom housing section 140 of the housing body 110. In this embodiment, the opposing main sidewalls 110*c* of the housing body 110 define a plurality of sidewalls of the second bottom housing section 140.

In some embodiments of the present disclosure, the plurality of secondary outlets 142 are structured so as to specifically control the flow of rainwater that has been diverted into the water-receiving reservoir 144 of the housing body 110. In these embodiments, the plurality of secondary outlets 142 are relatively positioned so as to prioritize the flow of rainwater through certain secondary outlets 142 of the plurality of secondary outlets 142.

In an embodiment such as shown in FIGS. 1 to 2B, 4A to 5B and 7A to 7C, the plurality of secondary outlets 142 are positioned on a plurality of sidewalls of the second bottom housing section 140 and on the front wall 110*b* of the housing body 110. In this embodiment, the arrangement of the plurality of secondary outlets 142 effectively defines two rows of secondary outlets 142 for the plurality of secondary outlets 142 (i.e., an upper row and a lower row of the secondary outlets 142). When the water deflector 150 is in the second deflection position and rainwater is deflected into the water-receiving reservoir 144 such that the rainwater begins to accumulate in the water-receiving reservoir 144, the presence of the upper and lower rows of the plurality of secondary outlets 142 will result in the prioritization of rainwater flow out some of the plurality of secondary outlets 142. Gravity will cause the rainwater to collect at the bottom of the water-receiving reservoir 144, and the rainwater will flow out the secondary outlets 142 of the lower row first. When rainwater flows into the water-receiving reservoir 144 faster than the secondary outlets 142 of the lower row can drain it, a level of rainwater in the water-receiving reservoir 144 will rise and eventually begin to flow out the upper row of the plurality of secondary outlets 142. As described above, when rainwater flows into the water-receiving reservoir 144 faster than all of the plurality of secondary outlets 142 can divert it, the rainwater will rise and flow out of the water-receiving reservoir 144 and out the primary outlet 122.

Said another way, the plurality of secondary outlets 142 include at least a first subset of outlets, and a second subset of outlets that are disposed above the first subset of outlets such that rainwater in the water-receiving reservoir 144 will flow through the first subset of outlets prior to flowing into any of the second subset of outlets.

In the specific embodiment provided in FIGS. 1 to 2B, 4A to 5B and 7A to 7C, each sidewall of the plurality of sidewalls of the second bottom housing section 140 includes a pair of secondary outlets 142, one positioned below the other. The front wall 110*b* includes four secondary outlets 142 positioned thereon in a rectangular pattern. The bottom secondary outlets 142 of the four secondary outlets 142 on the front wall 110*b* and the bottom secondary outlet 142 of each pair of secondary outlets 142 on each sidewall of the plurality of sidewalls are spaced from a bottommost extent of the second bottom housing section 140 in order to allow rainwater to collect in the water-receiving reservoir 144 prior to the rainwater being drained by any of the plurality of secondary outlets 142

In an embodiment such as shown in FIGS. 1 to 2B, 4A to 5B and 7A to 7C, at least one secondary outlet 142 of the plurality of secondary outlets 142 includes a connector element 146 that is formed on an exterior of the housing body 110 and that is structured to be releasably connected to a fluid conduit 740 for fluidly connecting the fluid conduit 740 and the secondary outlet 142. In this embodiment, at least some of the plurality of secondary outlets 142 include an associated connector element 146 that is connected with the secondary outlet 142 and positioned on the exterior of the housing body 110. The connector element 146 is structured for receiving dispensing pipes, hoses, or other fluid conduits 740 for fluidly connecting the secondary outlet 142 to an external fluid reservoir. Additionally, or alternatively, the connector element 146 can be structured for receiving a closer device 750 for closing off the secondary outlet 142 associated with the connector element 146.

Figure 10A:
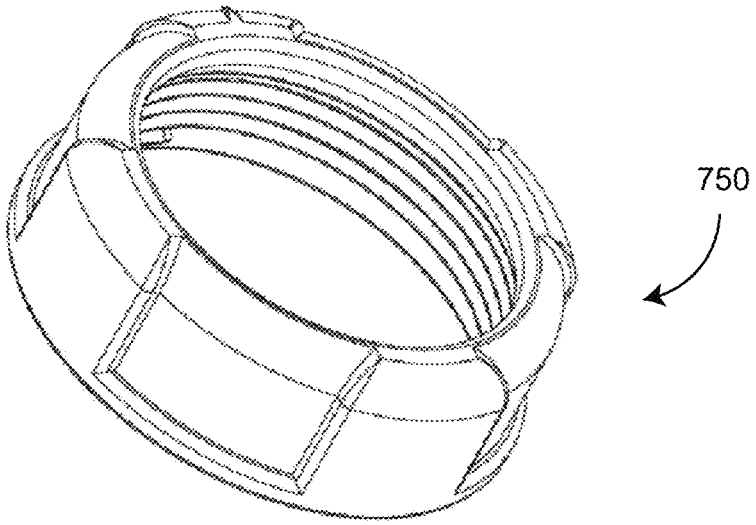
FIG. 10A shows an embodiment of a closer device for one of the plurality of secondary outlets of the rainwater diverter apparatus of FIG. 1.
Figure 10B:
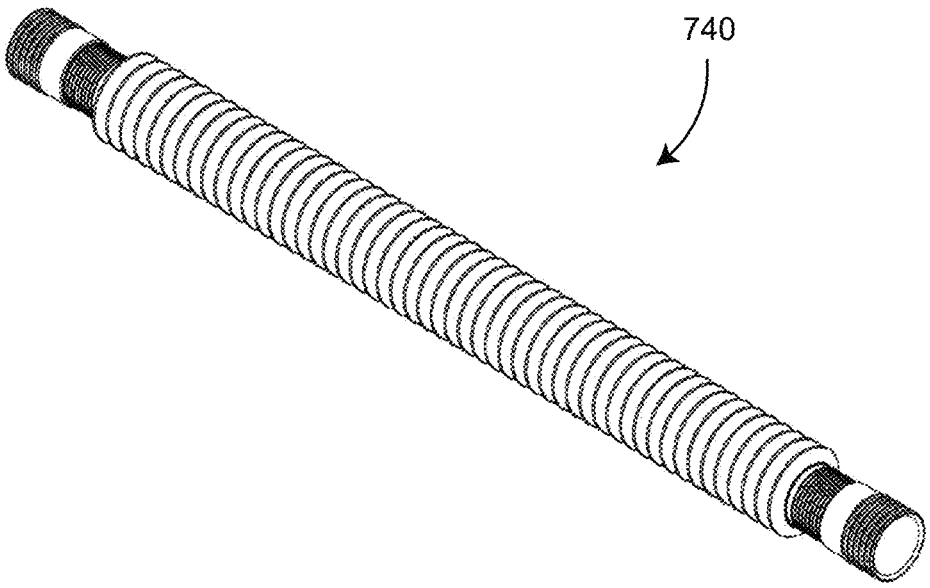
FIG. 10B shows an embodiment of a fluid conduit that is connectable to one of the plurality of secondary outlets of the rainwater diverter apparatus of FIG. 1.
Figure 10C:
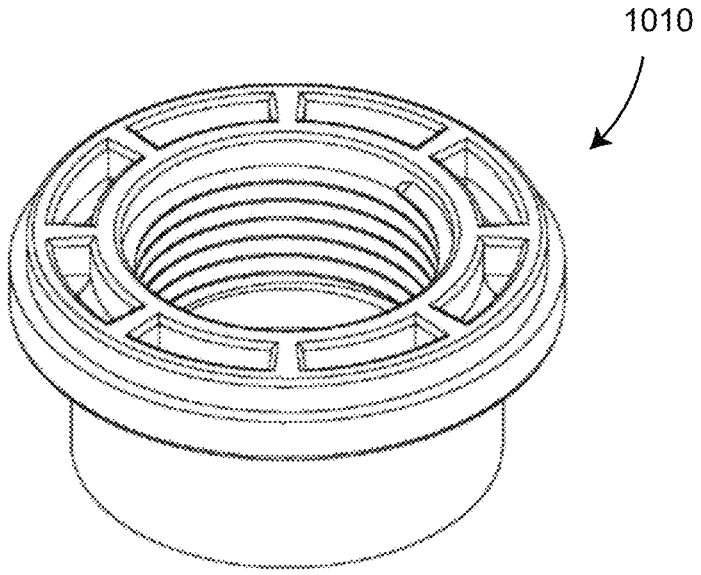
FIG. 10C shows an alternative embodiment of a connector for one of the plurality of secondary outlets of the rainwater diverter apparatus of FIG. 1, where the connector is formed as a plug.
Figure 10D:
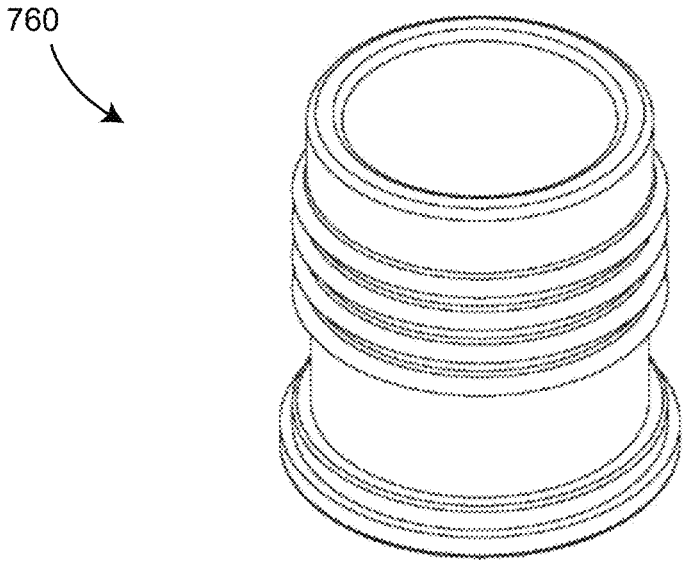
FIG. 10D shows another alternative embodiment of a connector for one of the plurality of secondary outlets of the rainwater diverter apparatus of FIG. 1, where the connector is formed as a straight outlet.

Alternative, exemplary connectors in the form of a plug 1010 and a straight outlet 760 are provided in FIGS. 10C and 10D, respectively. An exemplary version of the fluid conduit 740 is provided in FIG. 10B, and an exemplary closer device 750 is provided in FIG. 10A.

In an embodiment, the external fluid reservoirs to which the fluid conduits 740 are fluidly connected are storage devices which provides a means to redirect rainwater into and dispense rainwater from liquid handling containers such as barrels, drums, pails, swimming pools, hot tubs, cisterns, and water tanks. In this way, the rainwater diverter apparatus 100 can be provided as part of a broader diverter system which enables the collection of rainwater from non-permeable surfaces via a downspout, the diverting of the collected rainwater into a number of containers, and the dispensing of rainwater from the containers when desired.

In an additional embodiment, the connector element 146 is structured to connect to other types of fluid elements, such as a rainwater distributing pump and vacuum, or a rainwater heating devices that prevent freezing of the rainwater and provides easy internal access for cleaning and maintenance purposes, thereby making the rainwater diverter apparatus 100 fully user configurable.

The embodiments of the disclosures described herein are exemplary (e.g., in terms of materials, shapes, dimensions, and constructional details) and do not limit by the claims appended hereto and any amendments made thereto. Persons skilled in the art will appreciate that there are yet more alternative implementations and modifications possible, and that the following examples are only illustrations of one or more implementations. The scope of the disclosure, therefore, is only to be limited by the claims appended hereto and any amendments made thereto.

The specific embodiments described above have been shown by way of example, and it should be understood that these embodiments may be susceptible to various modifications and alternative forms. It should be further understood that the above-described embodiments are intended to be examples of the present disclosure and alterations and modifications may be affected thereto, by those of skill in the art, without departing from the scope of the disclosure that is defined solely by the claims appended hereto.

REFERENCE NUMERALS

100 rainwater diverter apparatus
102 inlet
110 housing body
110*a* rear wall
110*b* front wall
110*c* opposing main sidewalls
112 support lip
114 check blocks
120 first bottom housing section
122 primary outlet
140 second bottom housing section
142 secondary outlets
144 water-receiving reservoir
146 connector element
150 water deflector
160 removable reducer section
210 apex
222 substantially horizontal surface
224 substantially vertical surface
230 filter element
232 filter holder
234 filter screen
242 sloped wall
242*a* downwardly angled section

242*b* curved section
250 blocking wall
310 deflecting lip
310*a* first side of the deflecting lip
310*b* second side of the deflecting lip
310*c* terminal edge of the deflecting lip
350 deflecting surface
352 upstream end
354 downstream end
356 pair of side walls
358 handle element
360 abutting edge
700 top cover assembly
710 front panel
712 securing flange
720 middle panel
722 plurality of apertures
724 cut-lines
730 rear panel
732 plurality of connecting projections
740 fluid conduit
750 closer device
760 connector
1010 connector

What is claimed is:

1. A rainwater diverter apparatus for use on a downspout, the rainwater diverter apparatus comprising a housing body that includes:

an inlet that is shaped to interface with an upstream portion of the downspout for fluidly connecting an interior of the housing body and the downspout;

a primary outlet that is formed in a first bottom section of the housing body and that is shaped to interface with a downstream portion of the downspout;

a water-receiving reservoir that is formed within a second bottom section of the housing body that is separate from the first bottom section; and a plurality of secondary outlets that are positioned on the second bottom section of the housing body; and a water deflector that is positionable within the housing body in both a first deflection position for deflecting rainwater towards the primary outlet and a second deflection position for deflecting rainwater towards the water-receiving reservoir, an underside of the water deflector including a deflecting lip that has a first side, a second side, and a terminal edge formed between the first and second sides;

wherein each of the first side and the second side of the deflecting lip extend upwardly away from the terminal edge of the deflecting lip such that the movement of rainwater up the underside of the water deflector once the rainwater has been deflected along the water deflector is inhibited; and wherein the water deflector is shaped such that when the water deflector is in the first deflecting position, the entirety of the deflecting lip is disposed over the first bottom section for deflecting the rainwater into only the first bottom section, and when the water deflector is in the second deflecting position, the entirety of the deflecting lip is disposed over the second bottom section for deflecting the rainwater into only the second bottom section.

2. The rainwater diverter apparatus of claim 1, wherein the terminal edge of the deflecting lip is angled upwards towards an upstream end of the water deflector for further inhibiting the movement of rainwater up the underside of the water deflector once the rainwater has been deflected along the water deflector.

3. The rainwater diverter apparatus of claim 1, further comprising:

a filter element that is connectable between the housing body and the water deflector, when the water deflector is in either of the first or second deflection positions, for capturing debris from rainwater that is deflected by the water deflector.

4. The rainwater diverter apparatus of claim 3, wherein the deflecting lip is sized such that when the water deflector is mounted in either the first or second deflection position and the filter element is connected between the water deflector and the housing body, a bottommost extent of the deflecting lip will extend beyond a bottommost extent of the filter element such that any rainwater which passes through along the deflecting lip will be guided against the filter element.

5. The rainwater diverter apparatus of claim 3, wherein the filter element includes:

a filter holder that is connectable between the housing body and a portion of the water deflector that is proximate the downstream end of the water deflector; and a filter material that is mountable within the filter holder and that is structured for catching the debris from the rainwater deflected by the water deflector.

6. The rainwater diverter apparatus of claim 1, wherein the housing body includes an apex that separates the first and second bottom housing sections; and wherein the rainwater diverter apparatus further comprises a blocking wall that is structured to be connected between the underside of the water deflector and the apex of the housing body for fluidly separating a portion of the housing body above the first bottom housing section and another portion of the housing body above the second bottom housing section.

7. The rainwater diverter apparatus of claim 1, wherein the water deflector is formed such that when the water deflector is mounted in either of the first or second deflection positions within the housing body, an upstream end of the water deflector will be positioned at a higher vertical point than the downstream end of the water deflector for deflecting rainwater along a deflecting surface of the water deflector under the influence of gravity.

8. The rainwater diverter apparatus of claim 1, wherein the water-receiving reservoir is formed such that when rainwater is diverted into the water-receiving reservoir at a faster rate than a rate at which rainwater can flow out the plurality of secondary outlets, the rainwater within the water-receiving reservoir will rise and spill out of the water-receiving reservoir; and wherein the first and second bottom sections of the housing body are relatively positioned such that rainwater that spills out of the water-receiving reservoir will flow into the first bottom section and through the primary outlet.

9. The rainwater diverter apparatus of claim 1, wherein the plurality of secondary outlets are positioned on at least one sidewall of the second bottom section of the housing body.

10. The rainwater diverter apparatus of claim 9, wherein the plurality of secondary outlets include at least a first subset of outlets, and a second subset of outlets that are disposed above the first subset of outlets such that rainwater in the water-receiving reservoir will flow through the first subset of outlets prior to flowing into any of the second subset of outlets.

11. The rainwater diverter apparatus of claim 1, wherein a cross-sectional area of the inlet is substantially equivalent to a cross-sectional area of the primary outlet such that the bottlenecking of rainwater flowing through the primary outlet is substantially inhibited; and wherein the cross-sectional area of the inlet is substantially equivalent to a combined cross-sectional area of the plurality of secondary outlets such that the bottlenecking of rainwater flowing through the plurality of secondary outlets is substantially inhibited.

12. The rainwater diverter apparatus of claim 1, wherein the water-receiving reservoir includes a sloped wall that is positioned to transport debris flushed upwards along the sloped wall towards the primary outlet, during entry of water into the water-receiving reservoir.

13. A rainwater diverter apparatus for use on a downspout, the rainwater diverter apparatus comprising a housing body that includes:

an inlet that is shaped to interface with an upstream portion of the downspout for fluidly connecting an interior of the housing body and the downspout;

a primary outlet that is formed in a first bottom section of the housing body and that is shaped to interface with a downstream portion of the downspout;

a water-receiving reservoir that is formed within a second bottom section of the housing body that is separate from the first bottom section; and a plurality of secondary outlets that are fluidly connectable to at least one external collection reservoir and that are positioned on at least one sidewall of the second bottom section of the housing body; and a water deflector that is manipulatable between a first deflection position for deflecting rainwater towards the primary outlet, and a second deflection position for deflecting rainwater towards the water-receiving reservoir;

wherein a cross-sectional area of the inlet is substantially equivalent to a cross-sectional area of the primary outlet such that the bottlenecking of rainwater flowing through the primary outlet is substantially inhibited; and wherein the cross-sectional area of the inlet is substantially equivalent to a combined cross-sectional area of the plurality of secondary outlets such that the bottlenecking of rainwater flowing through the plurality of secondary outlets is substantially inhibited.

14. The rainwater diverter apparatus of claim 13, wherein the housing body is sized such that a cross section of the interior of the housing body proximate the inlet of the housing body is greater than or equal to a cross section of the upstream downspout for inhibiting the backup of rainwater entering the housing body through the upstream downspout.

15. The rainwater diverter apparatus of claim 13, wherein at least one secondary outlet of the plurality of secondary outlets includes a connector element that is formed on an exterior of the housing body and that is structured to be releasably connected to a fluid conduit for fluidly connecting the fluid conduit and the secondary outlet.

16. The rainwater diverter apparatus of claim 13, wherein the first bottom section of the housing body includes a substantially horizontal surface along a bottom end of the housing body;

wherein the second bottom section includes a hollow projection that defines the water-receiving reservoir and that projects downwards from the bottom end of the housing such that a bottommost extent of the water-receiving reservoir is positioned below the substantially horizontal surface of the first bottom section; and wherein the housing body includes an apex that separates the first and second bottom housing sections; and wherein the apex joins the substantially horizontal surface of the first bottom section and at least one wall of the hollow projection of the second bottom section.

17. The rainwater diverter apparatus of claim 13, wherein the housing body includes an interior dividing wall that extends across the interior of the housing body; wherein the first bottom section of the housing body is defined on a first side of the interior dividing wall; wherein the second bottom section of the housing body is defined on an opposing side of the interior dividing wall; and wherein the water-receiving reservoir is defined between one side of the interior dividing wall and a plurality of sidewalls of the housing body.

18. A rainwater diverter apparatus for use on a downspout, the rainwater diverter apparatus comprising a housing body that includes:

an inlet that is formed on a top end of the housing body and that is shaped to interface with an upstream portion of the downspout for fluidly connecting an interior of the housing body and the downspout;

a primary outlet that is formed in a first bottom section of the housing body and that is shaped to interface with a downstream portion of the downspout;

a water-receiving reservoir that is formed within a second bottom section of the housing body that is separate from the first bottom section; and a plurality of secondary outlets that are positioned on the second bottom section of the housing body and that are fluidly connectable to at least one external collection reservoir; and a water deflector that includes an upstream end, a downstream end, and a deflecting surface extending between the upstream and downstream ends, the water deflector being removably mountable within the interior of the housing body, at least partly below the inlet, in a first deflection position for deflecting rainwater towards the primary outlet in the first bottom section of the housing or a second deflection position for deflecting rainwater towards the water-receiving reservoir in the second bottom section of the housing wherein the deflector is structured such that:

i) in the first deflection position, a topmost extent of the water deflector is disposed above each of the first bottom section and the second bottom section for downwardly deflecting rainwater towards the primary outlet in the first bottom section of the housing; and ii) in the second deflection position, the topmost extent of the water deflector is disposed above each of the first bottom section and the second bottom section for downwardly deflecting rainwater towards the water-receiving reservoir in the second bottom section of the housing.

19. The rainwater diverter apparatus of claim 18, wherein the top end of the housing body includes at least one cut-line that is structured to be cut for removing at least one section of the top end of the housing body; and wherein the cut-line is formed on the top end of the housing body such that removing the at least one section of the top end increases the size of the inlet.

20. The rainwater diverter apparatus of claim 18, wherein the housing body includes a support lip formed along at least one interior surface of the housing body; and wherein the water deflector includes an abutting edge that is sized to be received and supported on the support lip of the at least one interior surface of the housing body for removably mounting the water deflector in each of the first or second deflection positions.

21. The rainwater diverter apparatus of claim 20, wherein the water deflector includes a pair of sidewalls that are disposed on opposing lateral sides of the deflecting surface; and wherein the abutting edge of the water deflector is formed along each of the pair of sidewalls and an upstream edge of the water deflector.

* * * * *